US007002611B2

(12) United States Patent
Mori et al.

(10) Patent No.: US 7,002,611 B2
(45) Date of Patent: Feb. 21, 2006

(54) THERMAL PRINTER

(75) Inventors: Yukihiro Mori, Shinagawa (JP); Yoshinari Takabatake, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 76 days.

(21) Appl. No.: 10/277,836

(22) Filed: Oct. 23, 2002

(65) Prior Publication Data

US 2003/0076401 A1 Apr. 24, 2003

(30) Foreign Application Priority Data

Oct. 23, 2001 (JP) ..... 2001-325101
Mar. 6, 2002 (JP) ..... 2002-060686

(51) Int. Cl.
*B41J 17/00* (2006.01)

(52) U.S. Cl. ..... 347/215

(58) Field of Classification Search ..... 347/215, 347/216, 218, 220, 197, 198
See application file for complete search history.

(56) References Cited

U.S. PATENT DOCUMENTS 5,063,395 A * 11/1991 Nuita et al. ..... 347/220
5,694,159 A * 12/1997 Kajiya et al. ..... 347/197
6,078,345 A * 6/2000 Yamakawa et al. ..... 347/218
6,222,576 B1 * 4/2001 Goto ..... 347/218
6,249,302 B1 * 6/2001 Sekiya ..... 347/220
6,765,602 B1 * 7/2004 Mori ..... 347/220

FOREIGN PATENT DOCUMENTS

JP 8-112951 5/1996
JP 2001-58453 3/2001

* cited by examiner

*Primary Examiner*—K. Feggins
(74) *Attorney, Agent, or Firm*—Staas & Halsey LLP

(57) ABSTRACT

A thermal printer, including a drive platen, which has its external dimensions reduced to a level suitable for use in connection with portable information apparatuses. The thermal printer includes a thermal head; a platen cooperating with the thermal head to nip a printing sheet between the platen and the thermal head; an elastic member elastically pressing the thermal head and the platen to each other; a frame carrying the thermal head in a fixed manner and the platen in a movable manner relative to the thermal head; and a drive mechanism driving the platen. The drive mechanism includes a rotation drive source, a gearing unit for transmitting a torque from the rotation drive source to the platen, and a pivot member capable of pivoting about a rotation axis of a gear, arranged prior to the platen in the gearing unit, together with the platen and following gears arranged behind the prior or former gear.

13 Claims, 16 Drawing Sheets

THERMAL PRINTER

BACKGROUND OF THE INVENTION

1. Field of the Invention

The present invention relates to a thermal printer.

2. Description of the Related Art

A thermal printer provided with a heat-sensitive printing section including a thermal head and a platen has a relatively small number of parts and is easily downsized, so that the thermal printer has been widely employed as a printer attached to a cash register, a portable terminal unit, an ATM, etc. Regarding this kind of thermal printer, a printer having a platen that functions as a back-up roller to realize stable printing on a printing sheet (or heat-sensitive paper) and also functions as a drive roller to continuously supply the printing sheet by frictional force, has been known as a compact printer that does not require an exclusive mechanism for supplying a printing sheet.

FIG. 22 exemplary shows several components of a conventional thermal printer having the above-described drive-roller platen. This thermal printer 200 includes a thermal head 202, a platen 204 cooperating with the thermal head 202 to nip a printing sheet P therebetween, a plate spring 206 elastically pressing the thermal head 202 against the platen 204, a drive mechanism 208 rotationally driving the platen 204, a frame unit 210 supporting the thermal head 202 and the platen 204, a control circuit board 212 electrically connected to the thermal head 202 and drive mechanism 208, and a casing (not shown) accommodating these components as well as a battery 214 in a suitable relative layout. Further, a head release lever (not shown) may be provided to shift the thermal head 202 against the biasing force of the plate spring 206, in order to facilitate the insertion of the printing sheet P between the thermal head 202 and the platen 204.

The thermal head 202 is structured by arranging a heat generating element on the surface of a substrate made of a hard material such as ceramic, and fixing the substrate to a metallic supporting plate having a reinforcing and heat-radiating function. The thermal head 202 is pivotably supported on the frame unit 210 via a shaft provided on the supporting plate. The platen 204 is rotatably supported by the frame unit 210 via a shaft and is driven by the drive mechanism 208 for rotation, to continuously feed the printing sheet P unrolled from a sheet roll R with the printing sheet P sliding between the thermal head 202 and the platen 204 under pressure. During this period, the heat generating element provided on the surface of the substrate is operated electrically, so that the thermal head 202 executes a desired printing onto the printing sheet P. The plate spring 206 generates a required level of contact pressure between the thermal head 202 and the platen 204 to absorb any dimensional and positional error of the head 202 and platen 204 and to realize a stable printing while following a change in the thickness of the printing sheet P. The drive mechanism 208 includes a rotation drive source 216, and a power transmission mechanism (not shown) for transmitting an output torque of the rotation drive source 216 to the platen 204. The control circuit board 212 is generally connected to the thermal head 202 and the rotation drive source 216 via a flexible wiring board 218.

The above-described thermal printer having the drive platen can be made more compact by omitting a mechanism exclusively acting to feed the printing sheet, so that it is expected that the thermal printer can be used in connection with various kinds of portable information apparatuses or hand-held operable devices, such as an electronic notebook, a personal digital assistance (PDA), a mobile phone, and the like. However, in the conventional thermal printer with the driving platen, it has been difficult to reduce the external dimensions of the thermal printer to a level suitable for use in the portable information apparatuses, because of a relative layout of the components incorporated in the printer.

Specifically, in the conventional thermal printer 200 having a general structure as shown in FIG. 22, the thermal head 202 is placed inside the frame unit 210 via the plate spring 206, to lean laterally against the platen 204 supported by the frame unit 210. Further, the rotation drive source 216 is located behind the frame unit 21, and the control circuit board 212 connected with the flexible wiring board 218 is disposed further behind the drive source. The conventional thermal printer incorporating these components in this relative layout has a difficulty in reducing the dimensions, particularly in the height and length (or depth) directions, of the casing to a level permitting it to be carried together with anyone of the above-described various information apparatuses.

In this respect, it may be appreciated that each of the essential components of the thermal printer has a dimension necessary and enough to exhibit its own required function, so that a thoughtless reduction in dimensions of the components, for the purpose of facilitating the reduction in dimensions of the printer, may have a risk of causing other inconveniences such as a degradation of performance. Further, it is a concern that the reduction in dimensions of the thermal printer may make it difficult to quickly set a printing sheet in a printable state.

SUMMARY OF THE INVENTION

It is, therefore, an object of the present invention to provide a thermal printer, having a drive platen, capable of reducing the external dimensions of the thermal printer to a level suitable for use in connection with portable information apparatuses, while maintaining a required printing function.

It is another object of the present invention to provide a thermal printer having a drive platen, capable of presetting a printing sheet easily and quickly in a printable state, while reducing the external dimensions of the thermal printer.

In accordance with the present invention, there is provided a thermal printer comprising a thermal head; a platen cooperating with the thermal head to nip a printing sheet between the platen and the thermal head; an elastic member elastically pressing the thermal head and the platen to each other; a frame carrying the thermal head in a fixed manner and the platen in a movable manner relative to the thermal head; and a drive mechanism driving the platen; the drive mechanism including a rotation drive source, a gearing unit for transmitting a torque from the rotation drive source to the platen, and a pivot member capable of pivoting about a rotation axis of a gear, arranged prior to the platen in the gearing unit, together with the platen and following gears arranged behind the gear.

In this thermal printer, it is preferred that the elastic member applies an elastic biasing force to the pivot member for biasing the platen toward the thermal head about the rotation axis of the gear.

It is also preferred that the thermal head includes a printing face with a heat generating element located therein, and that the frame includes a guide mechanism guiding the platen along an arcuate path extending about the rotation axis of the gear to a printable position at which the platen is uniformly pressed against the heat generating element in the printing face.

The gear having the rotation axis as a pivoting center of the pivot member may be a driving gear fixed to an output shaft of the rotation drive source.

It is also preferred that the thermal printer further comprises a sheet guide arranged near the platen to define a sheet passage, and that the sheet guide is interlocked with the pivot member to be shiftable between a guide position close to the platen for inducing the printing sheet to be fed along a surface of the platen and an open position away from the platen for facilitating the printing sheet to be introduced into the sheet passage.

In this arrangement, the thermal printer may also comprise a connecting mechanism between the pivot member and the sheet guide, the connecting mechanism being capable of retaining the sheet guide in the open position under elastic biasing force of the elastic member.

It is advantageous that the thermal head is directly fixed to the frame, so that the frame serves to radiate heat generated in the thermal head.

The present invention also provides a thermal printer comprising a thermal head; a platen cooperating with the thermal head to nip a printing sheet between the platen and the thermal head; an elastic member elastically pressing the thermal head and the platen to each other; a frame carrying the thermal head in a fixed manner and the platen in a movable manner relative to the thermal head; and a rotation drive mechanism rotationally driving the platen; wherein the elastic member is arranged between the frame and the platen to bias the platen toward the thermal head by an elastic biasing force balanced in an axial direction of the platen.

In this thermal printer, it is preferred that the elastic member comprises a bar-shaped spring including a pair of elastic arm portions joined to the platen and a support portion located between the elastic arm portions and supported on the frame.

It is also preferred that the elastic member is shiftable between an operative position for applying the elastic biasing force to the platen and a release position for releasing the platen from the elastic biasing force.

In this arrangement, the thermal printer may further comprise a link member arranged between the elastic member and the platen, the link member transmitting a shifting motion of the elastic member between the operative position and the release position to the platen so as to move the platen.

It is also preferred that the thermal head includes a printing face with a heat generating element located therein, and that the frame includes a guide mechanism guiding the platen to a printable position at which the platen is uniformly pressed against the heat generating element in the printing face.

It is advantageous that the thermal head is directly fixed to the frame, so that the frame serves to radiate heat generated in the thermal head.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENT

Figure 1:
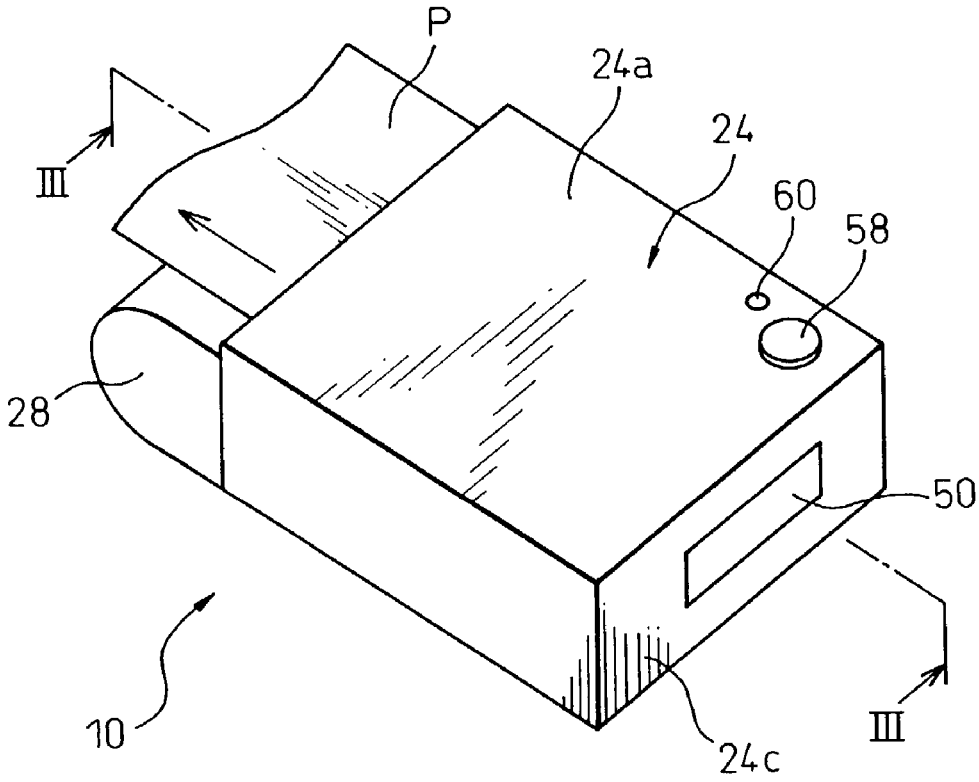
FIG. 1 is a perspective view showing a first embodiment of a thermal printer according the present invention.
Figure 2:
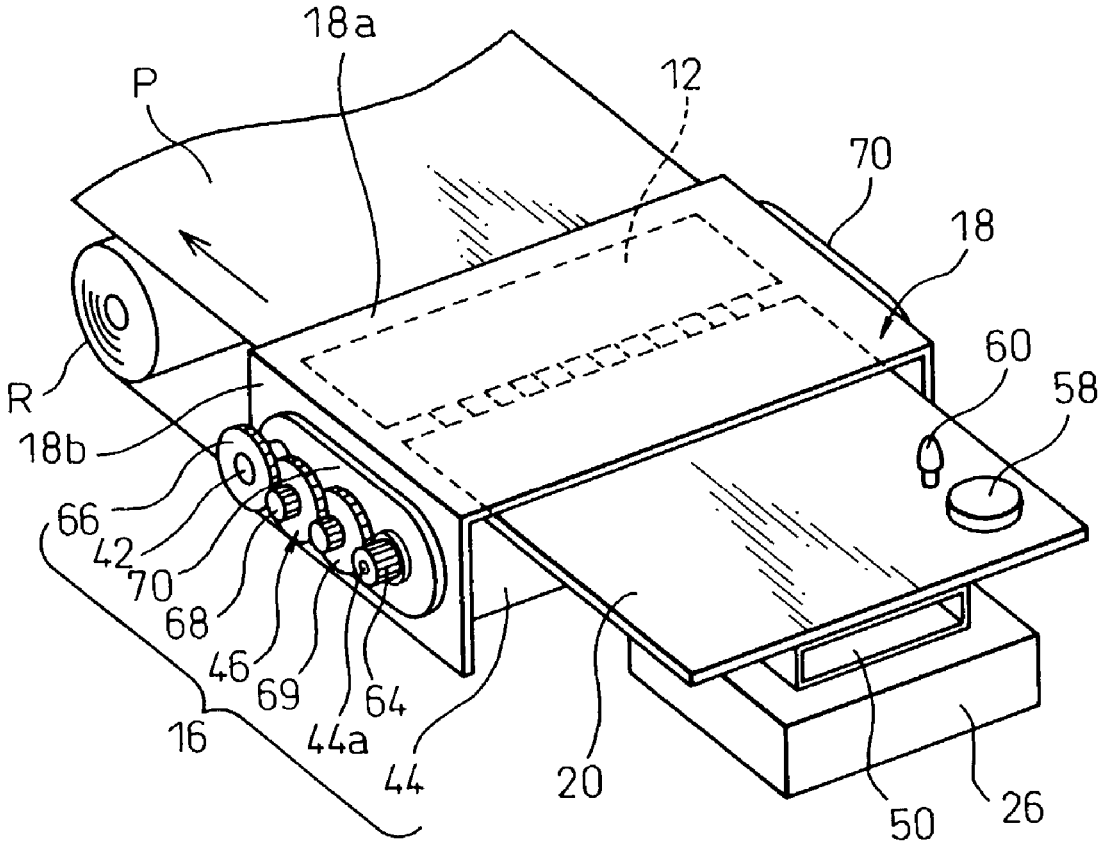
FIG. 2 is a perspective view schematically showing an internal structure of the thermal printer of FIG. 1.
Figure 3:
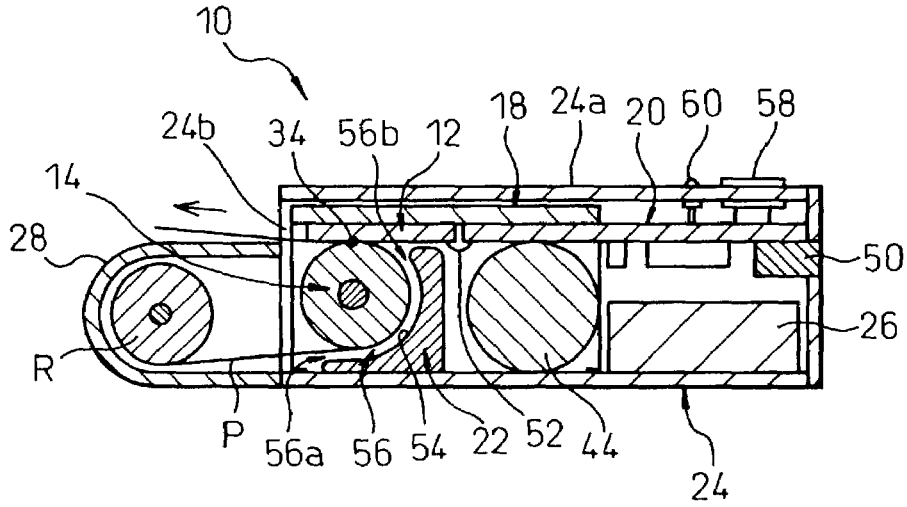
FIG. 3 is a sectional view of the thermal printer, taken along a line III—III of FIG. 1.

Referring now to the drawings, in which the same or similar components are denoted by common reference numerals, FIG. 1 shows the general appearance of a thermal printer 10, according to the first embodiment of the present invention, in an operating mode, FIG. 2 shows the internal structure of the thermal printer 10 in a schematic perspective view, and FIG. 3 shows the thermal printer 10 in a vertical sectional view. The thermal printer 10 of the illustrated embodiment is capable of being advantageously connected, particularly, to various kinds of portable information apparatuses for hand-held operation, such as an electronic notebook, a personal digital assistance (PDA), a mobile phone, and the like, and also has a portable structure enabling it to be carried as an independent apparatus together with a portable information apparatus. However, the usage of the thermal printer according to the present invention is not limited thereto.

The thermal printer 10 includes a thermal head 12, a platen 14 cooperating with the thermal head 12 to nip a printing sheet P therebetween under an elastic biasing force, a drive mechanism 16 rotationally driving the platen 14, and a frame unit 18 supporting both the thermal head 12 and the platen 14. The thermal printer 10 also includes a control circuit board 20 electrically connected to both the thermal head 12 and the drive mechanism 16, a sheet guide 22 arranged near the platen 14, and a casing 24 accommodates the thermal head 12, the platen 14, the drive mechanism 16, the frame unit 18, the control circuit board 20 and the sheet guide 22, in a suitable relative layout. The casing 24 further accommodates a battery 26, and is joined with a housing cover 28 for housing a web-like continuous printing sheet P wound in a roll shape (i.e., a sheet roll R).

Figure 4:
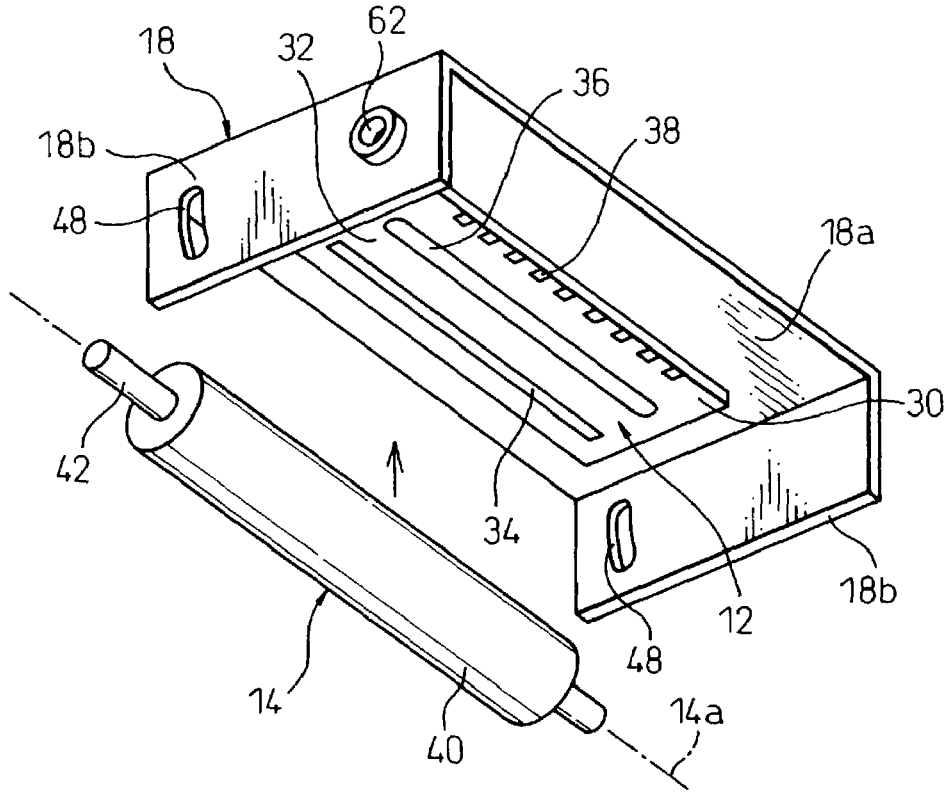
FIG. 4 is an exploded perspective view showing a printing section of the thermal printer of FIG. 1.

As shown in FIG. 4, the thermal head 12 includes a flat plate-shaped substrate 30, preferably made of a hard material such as ceramic, and a heat generating element 34 arranged at a desired position on a generally flat printing face 32 of the substrate 30. The thermal head 12 may have a line-dot structure wherein the heat generating element 34 is made by placing a large number of dot-shaped heat generators in a linear array on the printing face 32 of the substrate 30 and a printing operation is performed by selectively energizing the heat generators. In this arrangement, a head driving IC 36 is mounted on the printing face 32, for executing the selective energizing operation for the heat generating element 34. Also, a plurality of electrodes 38 are formed on the outer peripheral area of the printing face 32, for a connection with the control circuit board 20. The thermal head 12 is arranged so that the substrate 30 is fixed to the frame unit 18 at a predetermined position thereon with the printing face 32 being exposed, as described later.

The platen 14 includes a cylindrical body 40, preferably made of an elastic material such as a rubber, and a shaft 42 fixed to the body 40 and located along the center axis of the body 40, the shaft 42 projecting in an axial direction from the axial opposite end faces of the body 40. The platen 14 is rotatably supported on the frame unit 18 via the shaft 42, with the outer circumferential surface of the body 40 facing substantially parallel to the printing face 32 of the thermal head 12. Also, the platen 14 is biased by an elastic biasing force of an elastic member as described later, in such a direction that the body 40 is pressed against the printing face 32 of the thermal head 12.

The platen 14 is rotatably driven by the drive mechanism 16, to continuously feed the printing sheet P unwound from the sheet roll R while nipping the printing sheet P between the thermal head 12 and the platen 14 under pressing force. During this period, the thermal head 12 executes a desired printing operation onto the printing sheet P, with the heat generating element 34 provided on the printing face 32 electrically operating. In this way, the platen 14 functions as a back-up roller to realize a stable printing operation on the printing sheet P by the thermal head 12, and also functions as a drive roller to continuously feed the printing sheet P by a frictional force.

The drive mechanism 16 includes a rotation drive source 44 constructed, e.g., from a pulse motor, and a gearing unit 46 as a power transmission mechanism for transmitting an output torque of the rotation drive source 44 to the platen 14. The drive mechanism 16 will be explained in further detail later.

The frame unit 18 is made of a hard material such as a metal, and includes a ceiling plate part 18*a* having generally a rectangular shape in a plane view, and a pair of oppositely facing side plate parts 18*b* generally orthogonally extending from the ceiling plate part 18*a* in an integral manner along the lateral opposite ends of the ceiling plate part. The substrate 30 of the thermal head 12 is fixedly attached to the ceiling plate part 18*a* of the frame unit 18 on the inner side thereof closer to the side plate parts 18*b*, preferably with the back side of the substrate 30, opposite to the printing face 32, closely contacting to the inner side. Oblong or elliptical support openings 48 are formed in the pair of side plate parts 18*b* of the frame unit 18 at mutually opposing positions. The shaft 42 of the platen 14 is inserted at the opposite ends thereof through the support openings 48 in a rotatable and slidable manner while substantially eliminating a wobbling motion.

Accordingly, the frame unit 18 fixedly supports the thermal head 12 and, on the other hand, supports the platen 14 movably in a predetermined direction relative to the thermal head 12. Based on this structure, when continuous printing is performed on various kinds of printing sheets P having different thicknesses, the platen 14 moves, passively, in a direction toward or away from the thermal head 12 while being subjected to an elastic biasing force of the elastic member as described later, which makes it possible to accurately nip the printing sheets P between the thermal head 12 and the platen 14 under appropriate pressure. Also, at the time of preparing or setting a new printing sheet P in a printable state, it is possible to increase the distance between the thermal head 12 and the platen 14 so that a leading end of the printing sheet P is easily inserted between the thermal head 12 and the platen 14.

Based on the engagement between the shaft 42 and the pair of support openings 48, the platen 14 supported on the frame unit 18 is capable of shifting between a printable position at which the outer circumferential surface of the body 40 is uniformly pressed against the linear heat generating element 34 of the thermal head 12 and a non-operative position at which the body 40 is separated from the heat generating element 34. During a period when the platen 14 shifts relative to the thermal head 12, the frame unit 18 maintains a rotation axis 14*a* (FIG. 4) of the platen 14 substantially in parallel with the linear heat generating element 34 of the thermal head 12 under the engagement between the pair of support openings 48 and the platen shaft 42.

The frame unit 18 further serves to transmit heat generated from the thermal head 12 to the whole portion of the frame unit, including the ceiling plate part 18*a* and the side plate parts 18*b*, and thereby to quickly radiate the heat. From this viewpoint, it is advantageous that the frame unit 18 is made of a metal having an excellent thermal conductivity such as copper, iron or aluminum. Consequently, the thermal printer 10 does not need a metal supporting plate for heat-radiation, which has been used in a conventional thermal printer, so that it is possible to facilitate the reduction in dimensions of the casing 24. The substrate 30 of the thermal head 12 may be fixed to the ceiling plate part 18*a* of the frame unit 18 by using a bolt (not shown) or an adhesive (not shown) having excellent thermal conductivity.

The control circuit board 20 is, e.g., a printed circuit board, on which electronic parts such as a CPU are mounted. The control circuit board 20 has sufficient rigidity so as to be not easily deformed by at least its own weight, and is fixedly supported on the frame unit 18. A connector section 50 is also provided on the control circuit board 20 for electrical connection with a control circuit of an objective device (not shown) connectable to the thermal head 10. It is advantageous that the control circuit board 20 is fixedly attached to the ceiling plate part 18*a* of the frame unit 18 at a position near the thermal head 12. According to this structure, it is possible to electrically connect the thermal head 12 with the control circuit board 20 by using a wire 52 (i.e., a wire bonding technique), and not using the conventional flexible circuit board 218 (FIG. 22), which makes it possible to facilitate the reduction in dimensions of the casing 24.

The sheet guide 22 is formed to have, e.g., a resinous molded body, and includes a guide surface 54 having a concavely curved profile corresponding to the cylindrical outer circumferential surface of the body 40 of the platen 14. The sheet guide 22 is disposed between the side plate parts 18*b* of the frame unit 18 with the guide surface 54 facing oppositely to the platen body 40. The guide surface 54 of the sheet guide 22 preferably extends over, generally, the axial entire length of the platen body 40, so that a sheet passage 56 formed with a generally constant gap is defined between the guide surface 54, the outer circumferential surface of the platen body 40 and the side plate parts 18*b* of the frame unit 18. The sheet passage 56 opens at the first introducing end 56*a* thereof to the lower region of the platen 14 away from the thermal head 12, and also opens at the second discharging end 56*b* thereof to the upper region of the platen 14 near the thermal head 12.

The casing 24 is formed as a box having a generally rectangular parallelepiped shape, also preferably having a resinous molded body, and accommodates the above-described various components in a state where one wall 24*a* having a largest surface area is oriented to be used as a ceiling plate, i.e., a console board, to which the operator usually faces at the time of using the thermal printer 10. More particularly, the frame unit 18 is accommodated in the casing 24, with the ceiling plate 18*a* being oriented to be adjacent to the wall 24*a*. The control circuit board 20 is also fixed to the ceiling plate 18*a* of the frame unit 18 and, thereby, is accommodated in the casing 24 adjacent to the wall 24*a* in a similar manner. According to this structure, certain electric parts such as a power source switch 58 and an LED lamp 60, that are generally installed on the wall 24*a* acting as the console board, can be mounted directly on the control circuit board 20 without using an auxiliary connector such as another wiring board, and therefore, it is possible to further reduce the dimensions of the casing 24.

Further, the thermal head 12 and the platen 14, supported on the frame unit 18, are arranged near the opening 24*b* formed at one side of the rectangular parallelepiped shape of the casing 24. Thereby, the sheet guide 22 is disposed behind the platen 14 when seeing from the opening 24*b*. The housing cover 28 for housing the sheet roll R is fitted to the casing 24 at a location adjacent to the opening 24*b*. Therefore, the printing sheet P unwound from the sheet roll R is fed through the opening 24*b*, introduced into the sheet passage 56 defined between the platen 14 and the sheet guide 22 from the first end 56*a*, and discharged from the second end 56*b* of the sheet passage 56 to be passed through a press-abutting region between the thermal head 12 and the platen 14. After printing is carried out on the printing sheet P, the printing sheet P is fed out of the thermal printer 10 through the opening 24*b* again.

The rotation drive source 44 of the drive mechanism 16 is disposed further behind the sheet guide 22 and below the control circuit board 20 fixed to the ceiling plate 18*a* of the frame unit 18. The output shaft 44*a* of the rotation drive source 44 is inserted through a shaft bore 62 (FIG. 4) formed in one side plate part 18*b* of the frame unit 18, and a prime driving gear 64 in the gearing unit 46 is fixed to the distal end of the output shaft 44*a*. Similarly, the shaft 42 of the platen 14 is inserted through the support openings 48 formed in the side plate parts 18*b* of the frame unit 18, and a driven gear 66 in the gearing unit 46 is fixed to one distal end of the shaft 42. The gearing unit 46, including other intermediate gears 68 and 69, is accommodated in a certain space defined between one side plate part 18*b* of the frame unit 18 and one side wall of the casing 24. The connector section 50 mounted on the control circuit board 20 is arranged to be partially exposed in another side wall 24*c*, opposite to the opening 24*b*, of the casing 24. The connector section 50 is adapted to be connected to an objective device through a cable such as an electric cable or an optical or infrared cable (not shown).

Figure 22:
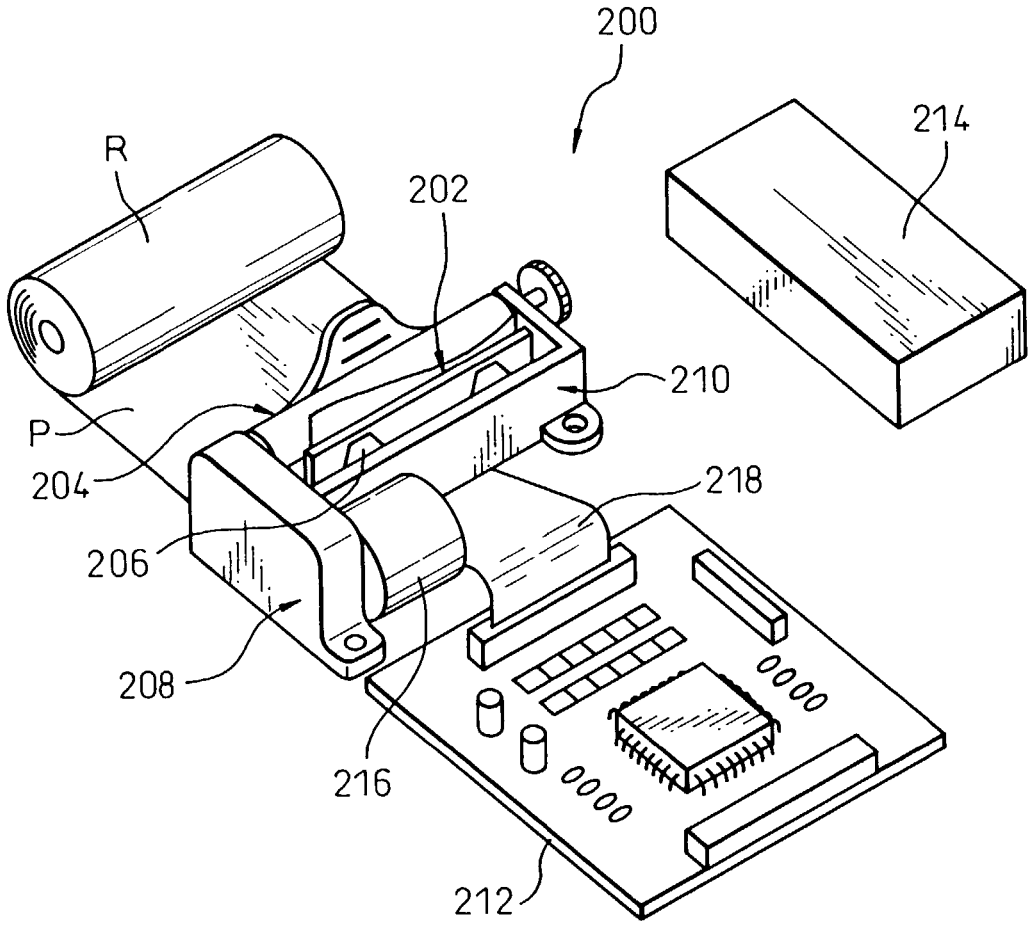
FIG. 22 is a perspective view schematically showing an internal structure of a conventional thermal printer.

Particularly, in the thermal printer 10 incorporating therein various kinds of components disposed in the above relative layout, the flat plate-shaped thermal head 12 is arranged along the ceiling plate of the casing 24, so that it is possible to effectively reduce the dimension of the casing 24 in the height direction. Also, the control circuit board 20 is arranged along the ceiling plate of the casing 24, so that it is possible to effectively reduce the dimension of the casing 24 in the length or depth direction. Specifically, when the thermal printer having a conventional structure as shown in FIG. 22 has the external dimensions (width×length×height) of, e.g., 80×100×25 (mm), it is possible to reduce the external dimensions of the thermal printer 10 including generally the same equipment to, e.g., 80×60×15 (mm). It is possible to set the dimension of the thermal printer 10 in the width direction so as to correspond to the width dimension of the printing sheet P suitably used in the objective device.

As already described, the thermal printer 10 is structured in such a manner that the platen 14 connected to the rotation drive source 44 via the gearing unit 46 can move relative to the thermal head 12. Therefore, particularly in the case where the platen 14 moves relative to the thermal head 12 due to the variation in thickness of the printing sheet P during a period when the printing sheet is fed by the platen 14 driven for rotation (e.g., during a printing operation), it is a concern that the meshing condition (e.g., backlash) between the driven gear 66 and a gear 68 in front of the driven gear in the gearing unit 46 changes, so as to cause a torque transmission loss or noise.

In order to eliminate the above concern, the thermal printer 10 employs the drive mechanism 16 having characteristic structures as follows. That is, the drive mechanism 16 includes a pivot member 70, as an auxiliary element of the power transmission mechanism. The pivot member 70 is rotationally connected to the platen 14, and is capable of pivoting about a rotation axis of a gear, arranged prior to the platen 14 in the gearing unit 46, together with the platen 14 and following gears arranged behind the prior gear. More specifically, the pivot member 70 is capable of pivoting about a rotation axis of the driving gear 64, together with the intermediate gears 68, 69 and the driven gear 66 as well as the platen 14.

Figure 5:
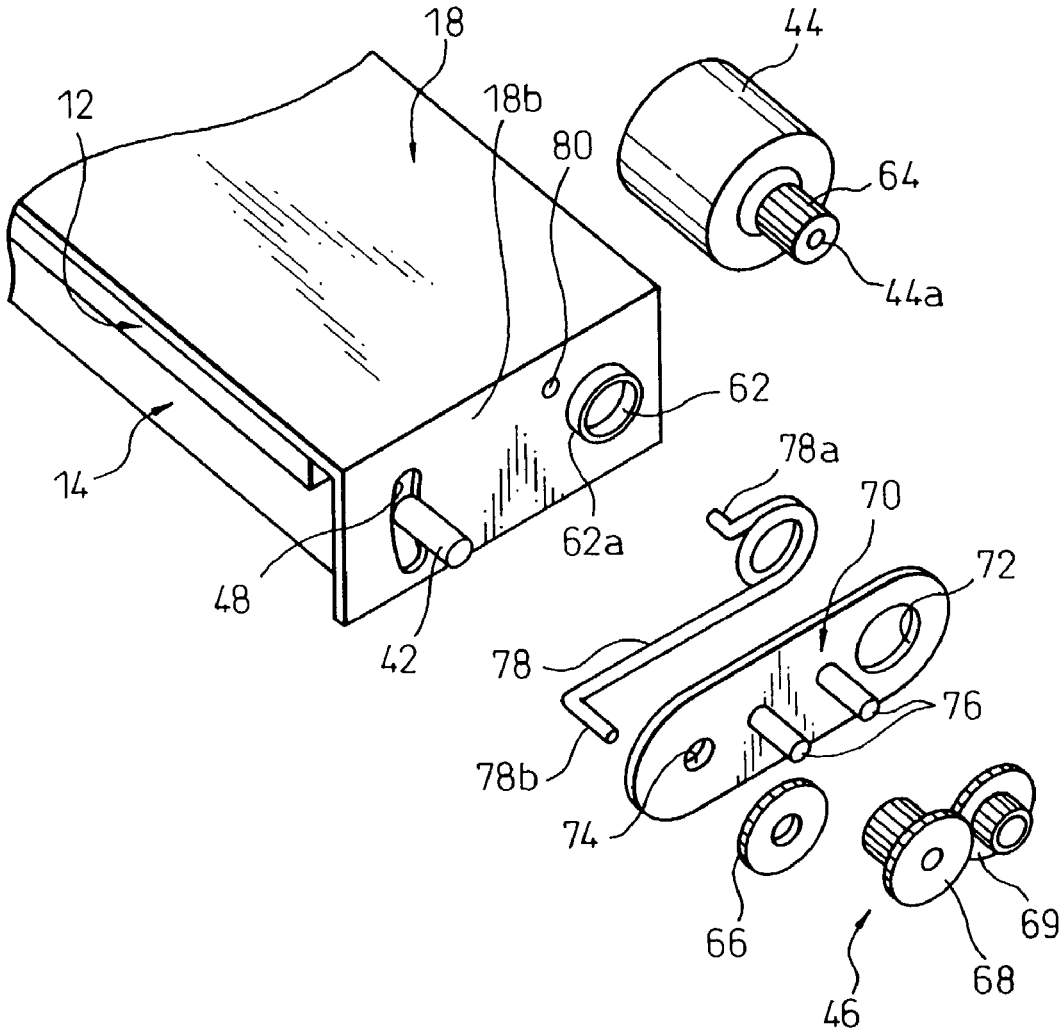
FIG. 5 is an exploded perspective view showing a drive mechanism of the thermal printer of FIG. 1.
Figure 6:
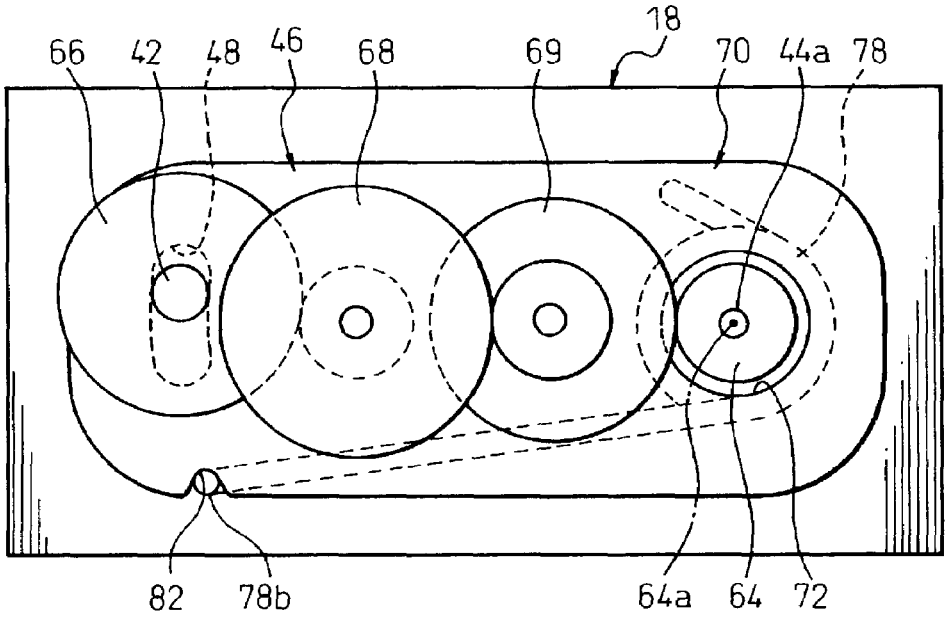
FIG. 6 is a front view showing the drive mechanism of FIG. 5 in an assembled state.

As shown in more detail in FIGS. 5 and 6, the pivot member 70 is formed as a plate-like member having a generally oblong or elliptical shape as a plan view, and also having, e.g., a resinous molded body. The pivot member 70 is attached to the frame unit 18 through a slidable engagement therebetween. That is, a cylindrical projection edge 62*a* projecting around the shaft bore 62 formed in the side plate part 18*b* of the frame unit 18 is slidably received in a circular receptive hole 72 formed through the pivot member 70 at a location near one longitudinal end thereof. When the rotation drive source 44 is disposed at a proper position relative to the frame unit 18, the output shaft 44*a* of the rotation drive source 44 is coaxially positioned with the shaft bore 62 and the receptive hole 72. Therefore, the pivot member 70 is capable of pivoting about the rotation axis 64*a* of the driving gear 64 fixed to the output shaft 44*a*, under the sliding engagement between the projection edge 62*a* of the shaft bore 62 and the receptive hole 72. Further, a circular bearing hole 74 is formed through the pivot member 70 at a location near another longitudinal end thereof. One axial end region of the platen shaft 42, to which the driven gear 66 is fitted, is rotatably received into the bearing hole 74.

The pivot member 70 is also provided at predetermined positions between the receptive hole 72 and the bearing hole 74 with a pair of shaft pins 76 uprightly projecting, and the intermediate gears 68 and 69 are rotatably fitted to the shaft pins 76. Therefore, the pair of intermediate gears 68 and 69 integrally follow the pivot motion of the pivot member 70 so as to pivot about the rotation axis 64*a* of the driving gear 64. The driving gear 64, the intermediate gears 68, 69 and the driven gear 66 are meshed with each other under a predetermined meshing condition, so as to transmit the output torque of the rotation drive source 44 to the platen 14 at a predetermined rate of rotation.

An elastic member 78 is provided between the frame unit 18 and the pivot member 70 for elastically pressing the thermal head 12 and the platen 14 to each other. The elastic member 78 is structured from, e.g., a torsion coil spring as illustrated. It is also possible to adopt other known elastic members, such as a tension coil spring, for the elastic member 78. The elastic member 78 made of a torsion coil spring is fitted at one end 78*a* thereof into a hooking hole 80 provided in the side plate part 18*b* of the frame unit 18, surrounds at a coil length thereof the projection edge 62*a* of the shaft bore 62, and is hooked at another end 78*b* on a dent 82 formed at the lower edge of the pivot member 70. The elastic member 78 applies elastic biasing force to the pivot member 70 in such a direction as to urge the platen 14 toward the thermal head 12 (i.e., a clockwise direction in the drawing) about the rotation axis 64*a* of the driving gear 64, under the engagement between the bearing hole 74 and the platen shaft 42. According to the above arrangement, the elastic member 78 generates a required contact pressure between the thermal head 12 and the platen 14, which makes it possible to absorb dimensional and positional errors of the thermal head 12 and the platen 14 as well as to achieve a stable printing operation in correspondence with a change in thickness of the printing sheet P, during a period when the platen 14 is located in a printable position and is abutted to the heat generating element 34 of the thermal head 12.

Figure 7:
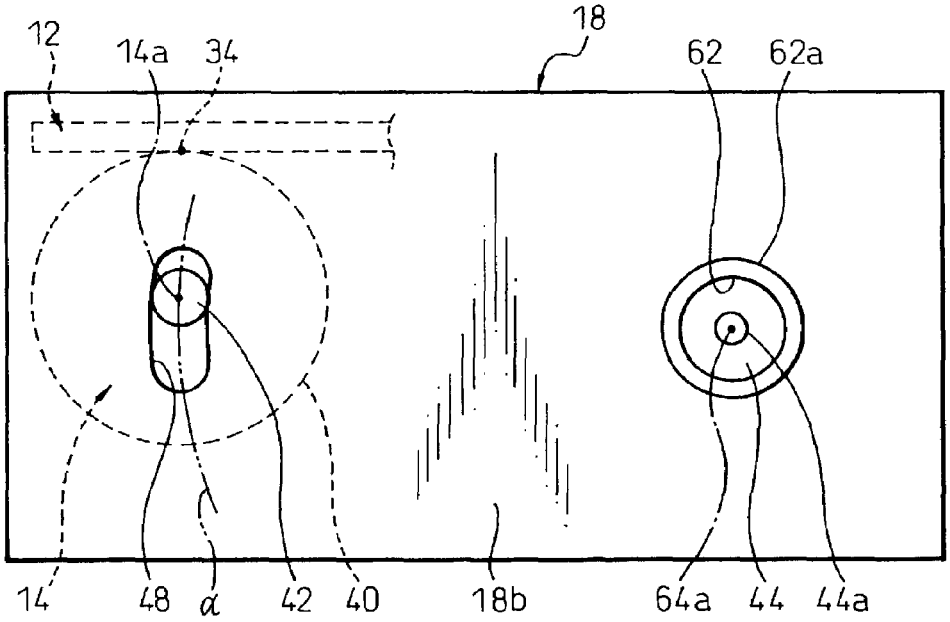
FIG. 7 illustrates an operation of the drive mechanism of FIG. 6.

According to the drive mechanism 16 having the above structure, when the platen 14 moves relative to the thermal head 12 due to, e.g., the variation in thickness of the printing sheet P during a period when the printing sheet is fed by the platen 14 driven for rotation (e.g., during a printing operation), the pivot member 70 simultaneously pivots about the rotation axis 64*a* of the driving gear 64 so as to follow the relative motion of the platen, under the engagement between the platen shaft 42 and the bearing hole 74. In this respect, as shown in FIG. 7, each of the support openings 48 formed in both side plates 18*b* of the frame unit 18 is provided with a curved shape along an arc $\alpha$ about the rotation axis 64*a* of the driving gear 64. Therefore, when the platen 14 moves relative to the thermal head 12, the platen shaft 42 slidably supported in the support openings 48 is guided along an arcuate path about the rotation axis 64*a* of the driving gear 64.

During a period when the platen 14 moves along the arcuate path, the driven gear 66 fixed to the platen shaft 42 and the pair of intermediate gears 68, 69 arranged on the pivot member 70 are displaced synchronously by the same center angle about the rotation axis 64*a* of the driving gear 64. As a result, the meshing condition (e.g., backlash) between any adjacent gears in the gearing unit 46 is maintained constant. Therefore, regardless of the fact that the driven gear 66 is displaced relative to the driving gear 64, it is possible to reduce the torque transmission loss and noise in the gearing unit 46 as much as possible.

Figure 8:
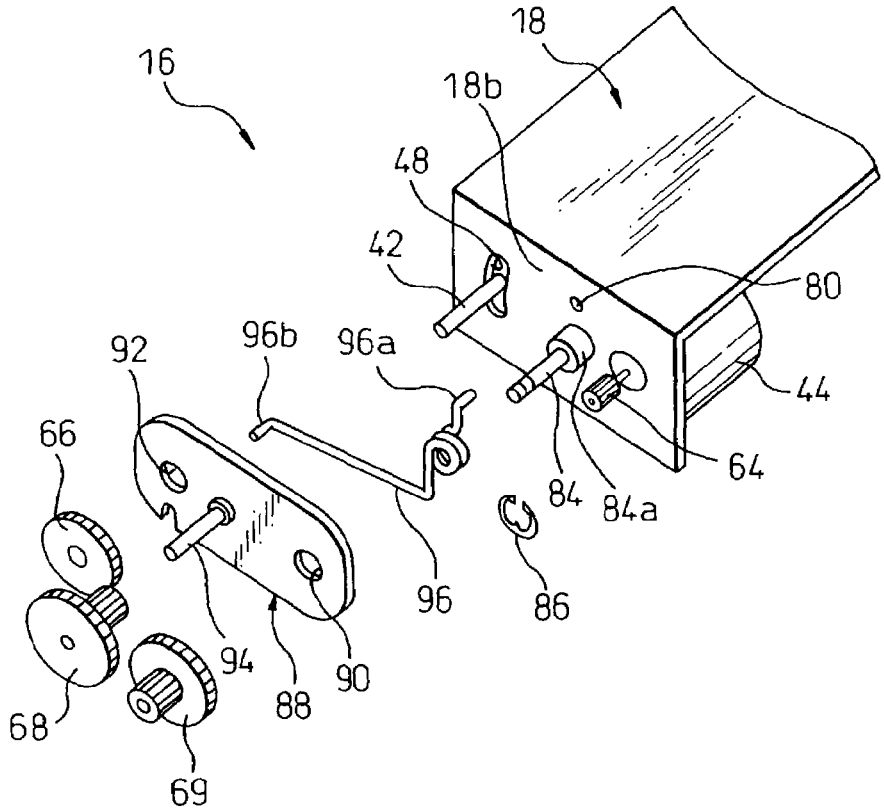
FIG. 8 is an exploded perspective view showing a modification of the drive mechanism.
Figure 9:
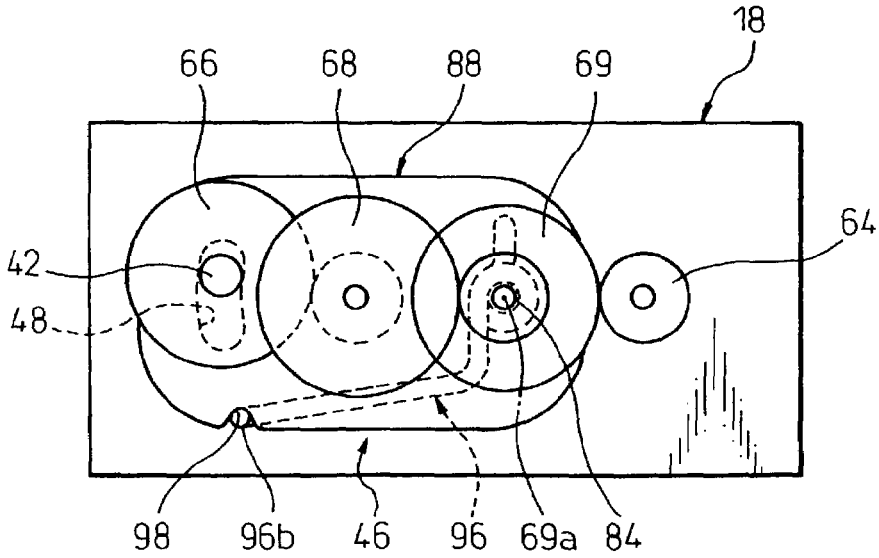
FIG. 9 is a front view showing the drive mechanism of FIG. 8 in an assembled state.

The above structure of the drive mechanism 16 can cause a similar effect in the case where the pivot member is structured to be able to pivot about the rotation axis of any one of the intermediate gears 68, 69 in the gearing unit 46. FIGS. 8 and 9 show a modification of the drive mechanism 16 having such a structure.

In this modified drive mechanism 16, the intermediate gear 69 arranged behind the driving gear 64 in the gearing unit 46 is rotatably fitted to a shaft pin 84 fixedly erected on the side plate part 18*b* of the frame unit 18 with a stopper 86. A pivot member 88 is provided as an auxiliary element of a power transmission mechanism. The pivot member 88 is rotationally connected to the platen 14, and is capable of pivoting about a rotation axis 69*a* of the intermediate gear 69, together with the other intermediate gear 68 and the driven gear 66 as well as the platen 14.

The pivot member 88 is formed as a plate-like member having a generally oblong or elliptical shape as a plan view, and also having, e.g., a resinous molded body. The pivot member 88 is attached to the frame unit 18 through a slidable engagement therebetween. That is, a cylindrical proximal end 84*a*, having a larger diameter, of a shaft pin 84 provided to project on the side plate part 18*b* of the frame unit 18 is slidably received in a circular receptive hole 90 formed through the pivot member 88 at a location near one longitudinal end thereof. Therefore, the pivot member 88 is capable of pivoting about the rotation axis 69*a* of the intermediate gear 69 fitted to the shaft pin 84, under the sliding engagement between the proximal end 84*a* of the shaft pin 84 and the receptive hole 90. Further, a circular bearing hole 92 is formed through the pivot member 88 at a location near another longitudinal end thereof. One axial end region of the platen shaft 42, to which the driven gear 66 is fitted, is rotatably received into the bearing hole 92.

The pivot member 88 is also provided at a predetermined position between the receptive hole 90 and the bearing hole 92 with one shaft pin 94 uprightly projecting, and the intermediate gear 68 at a driven side is rotatably fitted to the shaft pin 94. Therefore, the intermediate gear 68 integrally follows the pivot motion of the pivot member 88 so as to pivot about the rotation axis 69*a* of the former or prior intermediate gear 69. The intermediate gear 69 defining the pivot center of the pivot member 88 is not displaced relative to the driving gear 64 fixed to the output shaft 44*a* of the rotation drive source 44.

An elastic member 96 is provided between the frame unit 18 and the pivot member 88 for elastically pressing the thermal head 12 and the platen 14 to each other. The elastic member 96 made of a torsion coil spring, as illustrated, is fitted at one end length 96*a* thereof into a hooking hole 80 provided in the side plate part 18*b* of the frame unit 18, surrounds at a coil length thereof the proximal end 84*a* of the shaft pin 84, and is hooked at another end length 96*b* on a dent 98 formed at the lower edge of the pivot member 88. The elastic member 96 applies elastic biasing force to the pivot member 88 in such a direction as to urge the platen 14 toward the thermal head 12 (i.e., a clockwise direction in the drawing) about the rotation axis 69*a* of the intermediate gear 69, under the engagement between the bearing hole 92 and the platen shaft 42.

According to the above structure, when the platen 14 moves relative to the thermal head 12 due to, e.g., a variation in thickness of the printing sheet P during a period when the printing sheet is fed by the platen 14 driven for rotation (e.g., during a printing operation), the pivot member 88 simultaneously pivots about the rotation axis 69*a* of the intermediate gear 69 so as to follow the relative motion of the platen, under the engagement between the platen shaft 42 and the bearing hole 92. In this respect, the support openings 48 formed in the side plate parts 18*b* of the frame unit 18 are provided with a curved shape along an arc about the rotation axis 69*a* of the intermediate gear 69. Therefore, when the platen 14 moves relative to the thermal head 12, the platen shaft 42, slidably supported in the support openings 48, is guided along an arcuate path about the rotation axis 69*a* of the intermediate gear 69.

During a period when the platen 14 moves along the arcuate path, the driven gear 66 fixed to the platen shaft 42 and the pair of intermediate gears 68, 69 arranged on the pivot member 70 are displaced synchronously by the same center angle about the rotation axis 64*a* of the driving gear 64. As a result, the meshing condition (e.g., backlash) between any adjacent gears in the gearing unit 46 is maintained constant. Therefore, regardless of the fact that the driven gear 66 is displaced relative to the driving gear 64, it is possible to reduce the torque transmission loss and noise in the gearing unit 46 as much as possible.

As explained above, the drive mechanism of the thermal printer according to the present invention has installed therein a pivot member, as an auxiliary element of a power transmission mechanism, regardless of the number of intermediate gears in the gearing unit, the pivot member being rotatably connected to the platen and capable of pivoting about the rotation axis of any one particular gear (i.e., one of the driving gear and the intermediate gears), disposed in front of the platen in the gearing unit, together with the driven-side gear behind this particular gear, so that it is possible to accomplish the expected object. However, it is preferred that the motion of the platen, following the pivot motion of the pivot member, is defined in such a manner that the arcuate path of the platen extends in a direction close, as far as possible, to a direction of a normal line extending, relative to the printing face of the thermal head, through the heat generating element, from the viewpoint of ensuring a stable printing operation for the printing sheets having different thicknesses.

For example, in the embodiment shown in FIG. 7, it should be considered that the platen body 40 may be shifted away from the linear heat generating element 34 of the thermal head 12, due to the insertion of a printing sheet having certain thickness, from the printable position where the outer circumferential surface of the platen body 40 is in uniform contact with the heat generating element 34, in a direction significantly deviated from a direction of the normal line extending relative to the printing face through the heat generating element. In this case, it is a concern that it becomes difficult to accurately nip the printing sheet between the platen body 40 and the heat generating element 34 under optimum pressure, which may affect the printing quality. Therefore, it is advantageous that a pivot (or revolution) radius of the platen about the pivoting center of the pivot member is as long as possible and, from this viewpoint, it is most preferred that the rotation axis 64*a* of the driving gear 64 is defined as the pivoting center, as shown in FIG. 7.

In the above thermal printer 10, at the time of setting a new printing sheet to a printable state, it is possible to positively move the platen 14 in a direction away from the thermal head 12 against the elastic biasing force of the elastic members 78, 96, so as to suitably increase the distance between the thermal head 12 and the platen 14, which makes it possible to easily insert the leading edge of the printing sheet between the thermal head 12 and the platen 14. In this arrangement, the operator can manually operate the pivot member 70, 88 to shift the platen 14 to a non-operative position away from the thermal head 12. Also, in the case where the thermal printer 10 has a reduced dimension in the height direction, the introducing end 56*a* of the sheet passage 56 defined between the platen 14 and the sheet guide 22 might be narrow. Therefore, from the viewpoint of facilitating a sheet setting, it is advantageous that the sheet guide 22 is arranged to be movable relative to the platen 14 so that the introducing end 56*a* can be expanded as occasion demands.

FIGS. 10 to 12B show a major portion of a thermal printer, according to the second embodiment of the present invention, which is equipped with a movable sheet guide as explained above. The thermal printer of this embodiment has substantially the same structure as that of the thermal printer 10 explained above, except that a sheet guide and a pivot member of a drive mechanism are able to operate in a mutually interlocked manner. Therefore, components corresponding to those in the first embodiment are denoted by common reference numerals and explanations thereof are not given.

Figure 10:
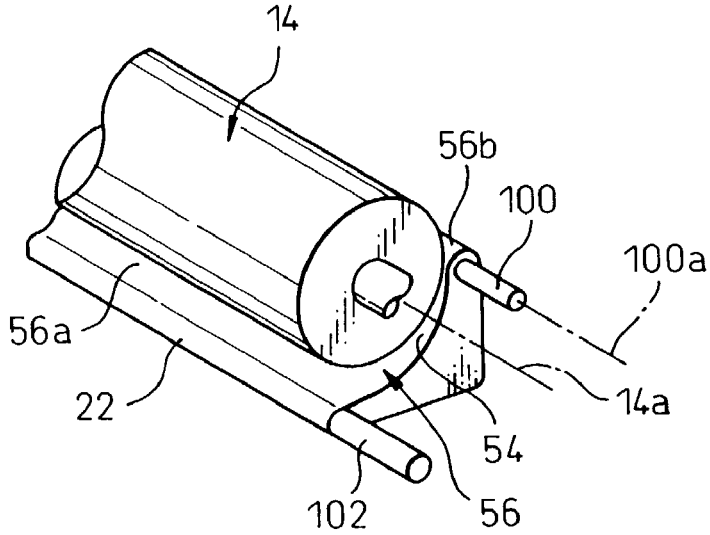
FIG. 10 is a perspective view showing a part of a sheet guide provided in a thermal printer according to the second embodiment of the present invention.
Figure 11:
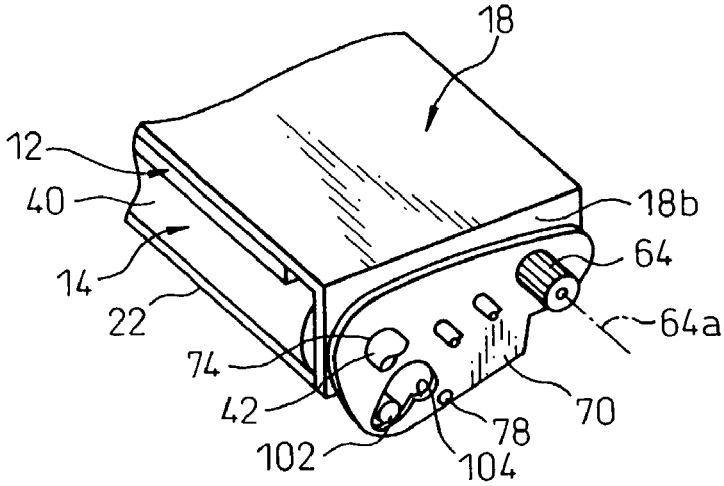
FIG. 11 is a perspective view partially showing a major portion of the thermal printer including the sheet guide of FIG. 10.

In the illustrated embodiment, a sheet guide 22 is provided with a pair of pivot axles 100 (only one pivot axle 100 is shown in FIG. 10) coaxially projecting from the opposite longitudinal end faces of the sheet guide 22, at a location near one end, defining a discharging end 56*b* of a sheet passage 56, of a guide surface 54, and with a link shaft 102 projecting generally in parallel with the pivot axle 100 from one longitudinal end face of the sheet guide 22, at a location near another end, defining an introducing end 56*a* of the sheet passage 56, of the guide surface 54. The sheet guide 22 is rotatably connected to the side plate parts 18*b* of a frame unit 18 via the pivot axles 100, in a state where a center axis 100*a* of the pivot axles 100 is disposed in parallel with a rotation axis 14*a* of a platen 14.

The link shaft 102 of the sheet guide 22 extends outward beyond the side plate part 18*b* of the frame unit 18, along which a pivot member 70 is disposed. On the other hand, the pivot member 70 is provided with an oblong or elliptical through hole or link aperture 104 capable of receiving the link shaft 102, at a location below a bearing hole 74 receiving a platen shaft 42. The sheet guide 22 rotates about the center axis 100*a* of the pivot axles 100 in a manner interlocked with the pivot motion of the pivot member 70, with the link shaft 102 being slidably received in the link aperture 104 of the pivot member 70.

Figure 12A:
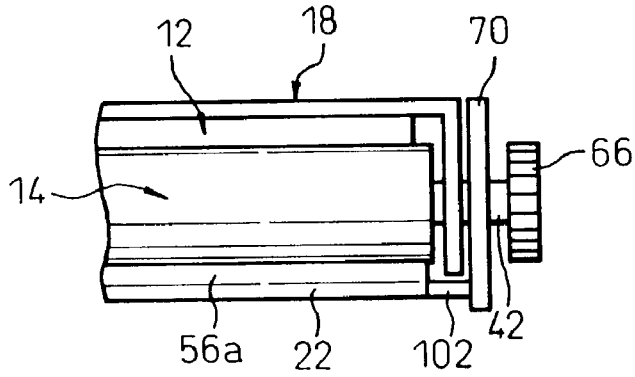
FIG. 12A illustrates an operation of the sheet guide of FIG. 10, in a guide position.

When the platen 14 is located in a printable position where the platen is pressed against the thermal head 12 under elastic biasing force of an elastic member 78, the sheet guide 22 is located in a guide position where the sheet guide comes close to the platen 14 to make a printing sheet run along the surface of a platen body 40. In this position, the opening of the introducing end 56*a* of the sheet passage 56 is set to a minimum dimension to meet the limitation of the external dimensions of the thermal printer (FIG. 12A). From this state, when the pivot member 70 is pivoted against the biasing force of the pivot member 70, the platen 14 shifts away from the thermal head 12 and, interlocked with this motion, the sheet guide 22 rotates away from the platen 14 about the pivot axles 100, under the sliding engagement between the link shaft 102 and the link aperture 104. As a result, the platen 14 is put into a non-operative position, and the sheet guide 22 is put into an open position where the introducing end 56*a* of the sheet passage 56 is expanded to a required opening dimension, which facilitates the introduction of the printing sheet into the sheet passage 56 (FIG. 12B).

Figure 12B:
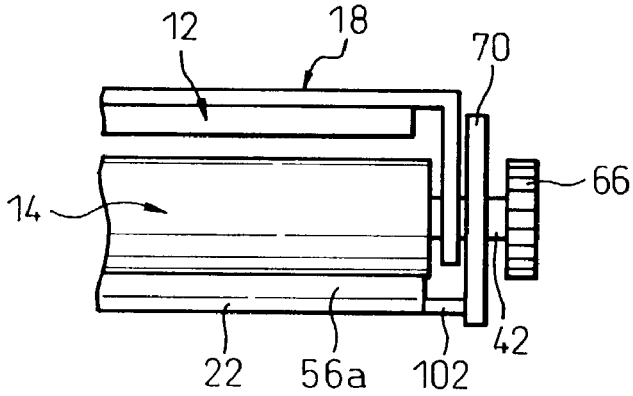
FIG. 12B illustrates the operation of the sheet guide in an open position.

As can be seen from FIG. 12B, in the state that the introducing end 56*a* of the sheet passage 56 is expanded, it is not only possible to easily introduce the printing sheet into the sheet passage 56, but it is also possible to smoothly and quickly insert the printing sheet guided along the sheet passage 56 into the open space between the thermal head 12 and the platen 14. Therefore, workability for sheet setting is extremely improved. Also, according to this structure, the operator can move the platen 14 by simply operating the sheet guide 22 with a hand inserted through the opening 24*b* of a casing 24 (FIG. 3).

Figure 13:
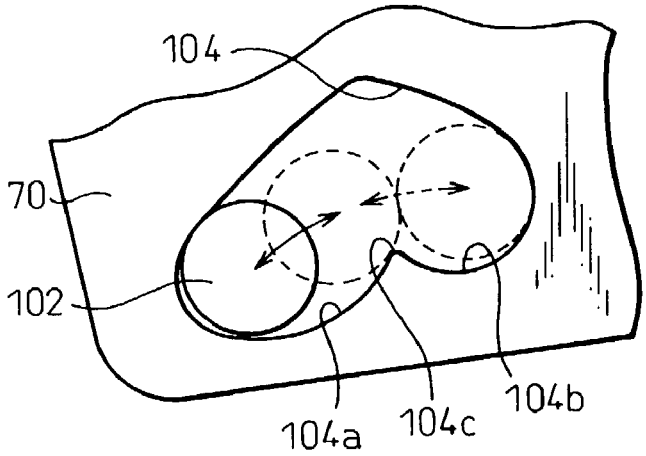
FIG. 13 is an enlarged view showing an interlocking mechanism of the sheet guide of FIG. 10.

In the above structure, from the viewpoint of facilitating the sheet setting work, it is advantageous that the sheet guide 22 is held in the open position against the biasing force of the elastic member 78 even when the operator has released his hand from the sheet guide 22. To this end, as shown in FIG. 13, it is possible to provide a cam profile for the link aperture 104 formed in the pivot member 70, which includes a stable holding portion 104*a* shaped with a relatively long concavely-curved edge, a temporary holding portion 104*b* shaped with a relatively short concavely-curved edge and an anchoring portion 104*c* shaped with a local convexly-curved edge smoothly connecting between the holding portions 104*a* and 104*b*.

Figure 14A:
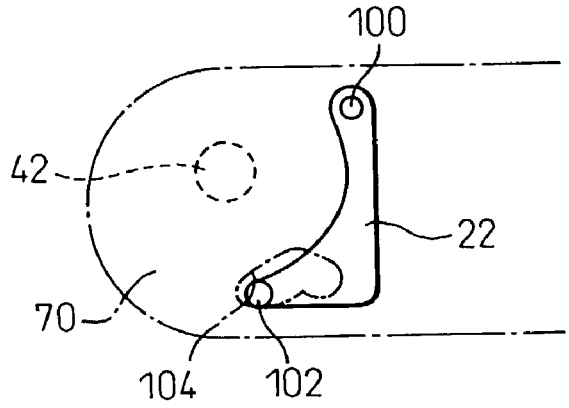
FIG. 14A illustrates an operation of the interlocking mechanism of FIG. 13, in a guide position.
Figure 14B:
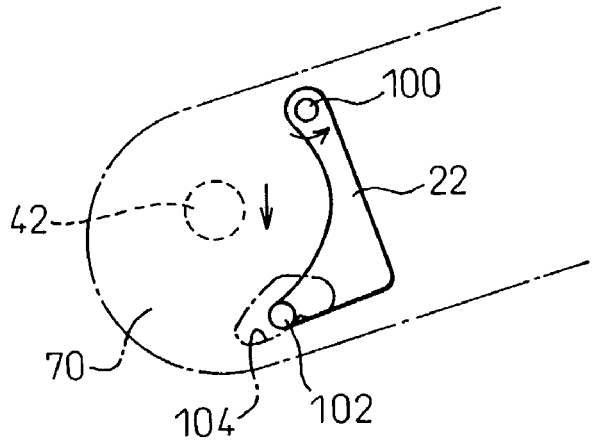
FIG. 14B illustrates the operation of the interlocking mechanism in an intermediate position.
Figure 14C:
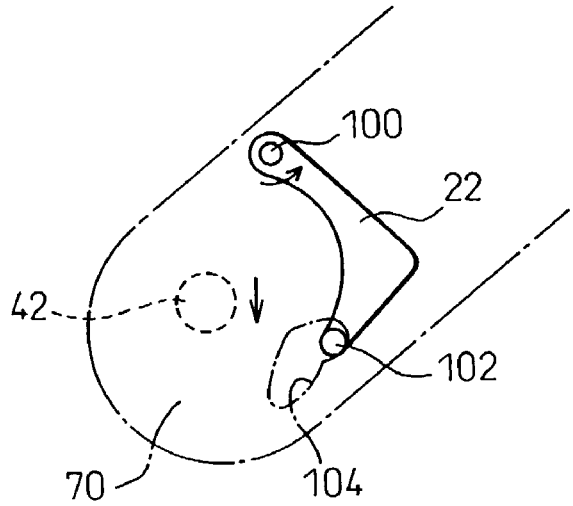
FIG. 14C illustrates the operation of the interlocking mechanism in an open position.

According to this structure, when the platen 14 is in a printable position, the sheet guide 22 is stably held in the guide position under the biasing force of the elastic member 78, with the link shaft 102 of the sheet guide 22 is received in the stable holding portion 104*a* of the link aperture 104 (FIG. 14A). From this position, when the sheet guide 22 is rotated away from the platen 14, the link shaft 102 slides along the stable holding portion 104*a* of the link aperture 104 and comes close to the anchoring portion 104*c* (FIG. 14B). When the sheet guide 22 has passed over a predetermined rotation-angle position, the link shaft 102 runs across the anchoring portion 104*c* of the link aperture 104, and then is received in the temporary holding portion 104*b* (FIG. 14C). In this position, the sheet guide 22 is temporarily held at the open position against the biasing force of the elastic member 78, with the link shaft 102 being anchored by the anchoring portion 104*c* of the link aperture 104 under the biasing force of the elastic member 78.

In the above operation mode, at an instant when the link shaft 102 runs across the anchoring portion 104*c* of the link aperture 104 and is received in the temporary holding portion 104*b*, the operator can perceive a click feeling from the sheet guide 22 through the hand touching the latter. Also, when the sheet guide 22 is shifted back from the open position to the guide position, the operator can operate the sheet guide 22 while perceiving a click feeling, by applying pressing force in excess of the biasing force of the elastic member 78 to the sheet guide 22. In this manner, the operability of certain members for the sheet setting work is extremely improved.

In the above embodiment, it is also possible to adopt another pivot member 70' (FIG. 2) including the pivoting center 64*a*, the bearing hole 74 and the link aperture 104, similar to those of the pivot member 70, so as to be arranged along another side plate part 18*b* of the frame unit 18, along which no gearing unit is disposed. In this arrangement, an additional link shaft disposed coaxially with the link shaft 102 is provided to project from the other axial end face of the sheet guide 22. The platen shaft 40 is joined through the opposite axial-end lengths thereof to the respective pivot members 70, 70', and the link shafts 102 of the sheet guide 22 are respectively engaged with the link apertures 104 of the pivot members 70, 70'. According to this arrangement, it is possible to improve the reliability of the interlocking operation between the platen 14 and the sheet guide 22, and also to shift the platen 14 while accurately maintaining the parallel correlation of the rotation axis 14*a* thereof with the heat generating element 34 of the thermal head 12. As a result, the operability of certain members for the sheet setting work is extremely improved.

Figure 15:
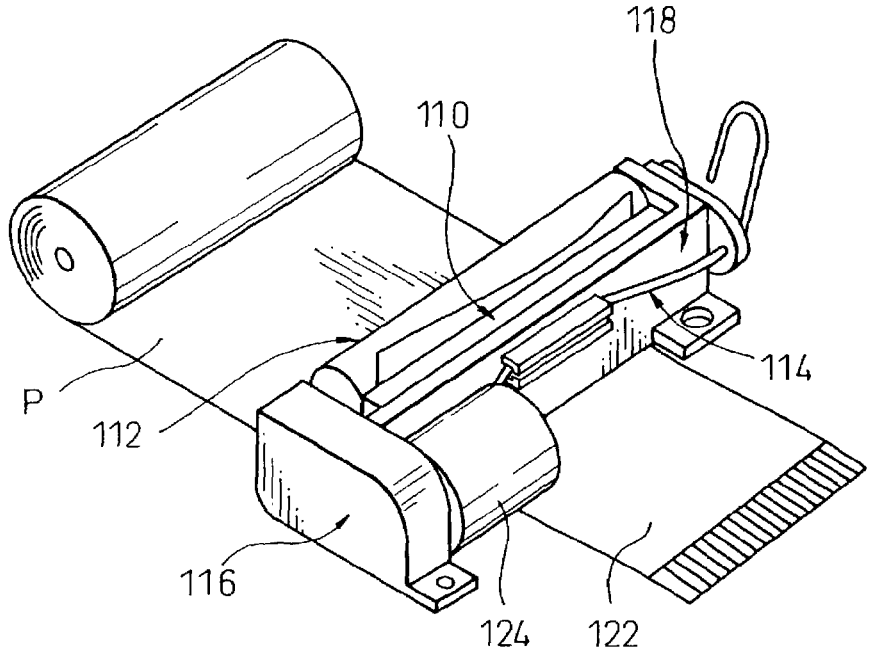
FIG. 15 is a perspective view showing a major portion of a thermal printer according to the third embodiment of the present invention.
Figure 16:
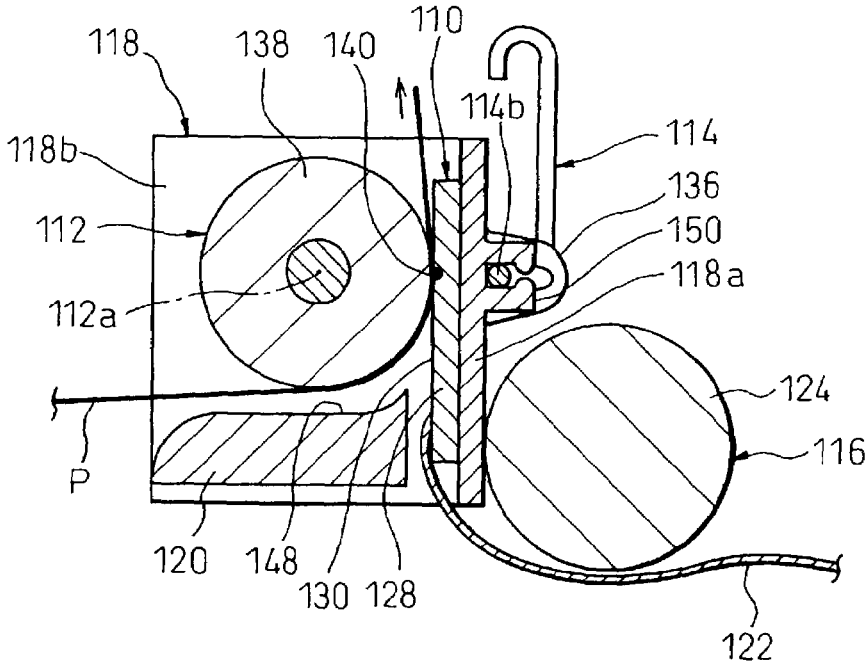
FIG. 16 is a sectional view showing the printer major portion of FIG. 15, during a sheet feeding operation.
Figure 17:
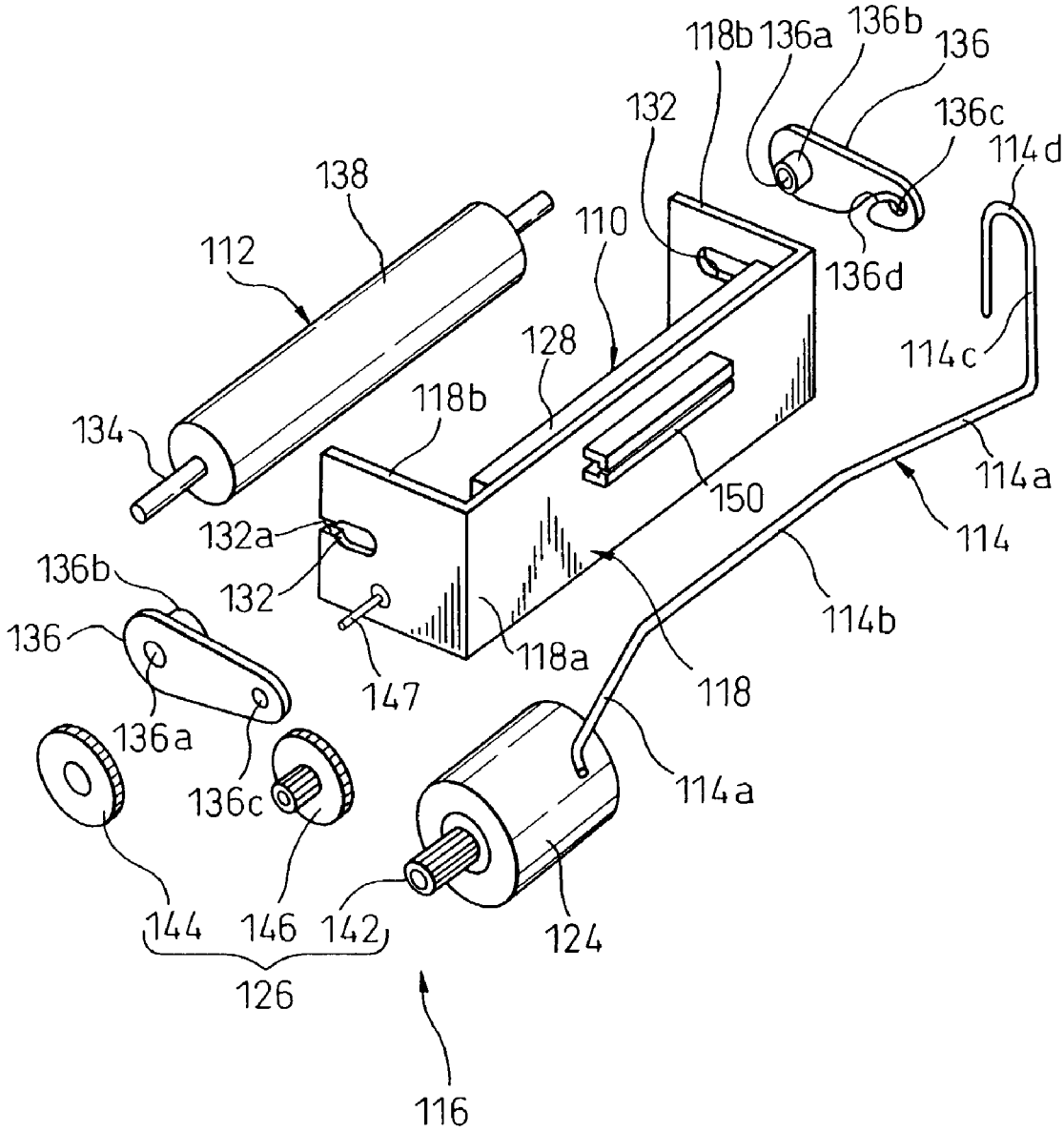
FIG. 17 is an exploded perspective view showing the printer major portion of FIG. 15.

In the thermal printer according to the present invention, it becomes possible to achieve the required reduction in external dimensions of the thermal printer if the number of incorporated components is effectively reduced, even when the components are arranged in a relative layout similar to that in the conventional thermal printer as shown in FIG. 22. FIGS. 15 to 17 show the major parts of a thermal printer according to the third embodiment of the present invention, in which the reduced components are arranged in such a relative layout. The thermal printer of this embodiment is capable of being advantageously connected particularly to various kinds of portable information apparatuses for hand-held operation, such as an electronic notebook, a personal digital assistant (PDA), a mobile phone, and the like, and also has a portable structure enabling it to be carried as an independent apparatus together with a portable information apparatus, in a way similar to the thermal printer of the first or second embodiment.

The thermal printer according to the third embodiment includes a thermal head 110, a platen 112 cooperating with the thermal head 110 to nip a printing sheet P therebetween under an elastic biasing force, an elastic member 114 elastically pressing the thermal head 110 and the platen 112 to each other, a rotation drive mechanism 116 rotationally driving the platen 112, and a frame unit 118 carrying the thermal head 110 and the platen 112 in a movable manner relative to each other. The thermal printer also includes a control circuit board (not shown) electrically connected to both the thermal head 110 and the rotation drive mechanism 116, a sheet guide 120 arranged near the platen 112, and a casing (not shown) accommodating the thermal head 110, the platen 112, the elastic member 114, the rotation drive mechanism 116, the frame unit 118, the control circuit board and the sheet guide 120, in a suitable relative layout. In this embodiment, the thermal head 110 is connected to the control circuit board (not shown) via a flexible wiring board 122.

The thermal head 110 and the platen 112 have substantially the same structures as the thermal head 12 and the platen 14 in the above-described thermal printer 10, respectively and, therefore, explanations thereof are omitted. The rotation drive mechanism 116 includes a rotation drive source 124 constituted as, e.g., a pulse motor, and a gearing unit 126 as a power transmission mechanism for transmitting an output torque of the rotation drive source 124 to the platen 112. The gearing unit 126 will be explained in further detail later.

The frame unit 118 is made of a hard material such as a metal, and includes a ceiling plate part 118*a* having generally a rectangular shape in a plan view, and a pair of oppositely facing side plate parts 118*b* generally orthogonally extending from the ceiling plate part 118*a* in an integral manner along the lateral opposite ends of the ceiling plate part 118*a*. A substrate 128 of the thermal head 110 is fixedly attached to the ceiling plate part 118*a* of the frame unit 118 on the inner side thereof extending between the side plate parts 18*b*, preferably with the back side of the substrate 128, opposite to the printing face 130 thereof, closely contacting to the inner side. Oblong or elliptical support openings 132 are formed in the pair of side plate parts 118*b* of the frame unit 118 at mutually opposing positions. A shaft 134 of the platen 112 is inserted at the opposite ends thereof through the support openings 132 in a rotatable manner. Each support opening 132 extends in a straight line, with the major or longer axis thereof being oriented in a direction generally orthogonal to a ceiling plate part 118*a* of the frame unit 118.

Bearing members 136, each having a bearing hole 136*a*, are rotatably mounted to the shaft 134 of the platen 112 at the opposite axial ends of the shaft. Each bearing member 136 is made from a hard plate material having generally an oblong or elliptical profile, and a generally cylindrical sleeve portion 136*b* defining the bearing hole 136*a* is uprightly formed on one face of the bearing member 136 at one longitudinal end area thereof. The sleeve portion 136*b* of each bearing member 136 is shaped and dimensioned so as to enable the sleeve portion 136*b* to be rotatably and slidably inserted into the support opening 132 formed in the side plate part 118*b* of the frame unit 118 while substantially eliminating a wobbling motion. Each bearing member 136 is mounted on the frame unit 118 with the sleeve portion 136*b* being inserted into the corresponding support opening 132.

Therefore, the shaft 134 of the platen 112 is rotatably received at the axial opposite lengths thereof in the bearing holes 136*a* of the bearing members 136, the bearing holes located inside the support openings 132 of the frame unit 118, and is also supported on the frame unit 118 through the sleeve portions 136*b* of the bearing members 136 in a manner slidable along the support openings 132. In the illustrated embodiment, in order to facilitate the assembling work, the support opening 132 provided in one side plate part 118*b* of the frame unit 118 is formed to open at the outer edge of the side plate part 118*b* via the slit 132*a*, through which the platen shaft 134 is able to pass. As described later, each bearing member 136 is fitted to the elastic member 114 through a fitting hole 136*c* formed at another longitudinal end of the bearing member 136, and acts to transmit the elastic biasing force of the elastic member 114 to the shaft 134 of the platen 112.

As explained above, the frame unit 118 fixedly supports the thermal head 110 and, on the other hand, supports the platen 112 movably in a predetermined direction relative to the thermal head 110 under the elastic biasing force of the elastic member 114. Based on this structure, when a continuous printing is performed onto various kinds of printing sheets P having different thicknesses, the platen 112 shifts passively in a direction toward or away from the thermal head 110 while being subjected to an elastic biasing force of the elastic member 114, which makes it possible to accurately nip the printing sheets P between the thermal head 110 and the platen 112 under appropriate pressure. Also, at the time of preparing or setting a new printing sheet P in a printable state, it is possible to suitably expand a distance between the thermal head 110 and the platen 112, so that a leading end of the printing sheet P is easily inserted between the thermal head 110 and the platen 112.

The frame unit 118 further serves to transmit heat generated from the thermal head 110 to the whole portion of the frame unit, including the ceiling plate part 118*a* and the side plate parts 118*b*, and thereby to quickly radiate the heat. From this viewpoint, it is advantageous that the frame unit 118 is made of a metal having an excellent thermal conductivity, such as copper, iron or aluminum. Consequently, this thermal printer is capable of omitting a metal supporting plate for heat-radiation, which has been used in a conventional thermal printer, so that it is possible to facilitate the reduction in dimensions of the casing. The substrate 128 of the thermal head 110 may be fixed to the ceiling plate part 118*a* of the frame unit 118 by using a bolt (not shown) or an adhesive (not shown) having excellent thermal conductivity.

Based on the slidable engagement between the sleeve portions 136*b* of the pair of bearing members 136, in which the shaft 134 are rotatably received, and the corresponding support openings 132 formed in the frame unit 118, the platen 112 supported on the frame unit 118 is capable of shifting between a printable position at which the outer circumferential surface of the platen body 138 is uniformly pressed against the linear heat generating element 140 (FIG. 16) of the thermal head 110 and a non-operative position at which the platen body 138 is separated from the heat generating element 140. During a period when the platen 112 shifts relative to the thermal head 110, the frame unit 118 maintains a rotation axis 112*a* (FIG. 16) of the platen 112 substantially in parallel with the linear heat generating element 140 of the thermal head 110 under the engagement between the pair of support openings 132 and the corresponding sleeve portions 136*b* of the bearing members 136.

The gearing unit 126 of the rotation drive mechanism 116 includes a driving gear 142 fixed to the output shaft of the rotation drive source 124, a driven gear 144 fixed to a distal end length of the platen shaft 134 extending through the bearing hole 136*a* of one bearing member 136, and an intermediate gear 146 operatively interposing between the driving gear 142 and the driven gear 144. The intermediate gear 146 is rotatably fitted to the shaft pin 147 uprightly projecting from the outer surface of one side plate part 118*b* of the frame unit 118. The gearing unit 126 transmits the torque of the rotation drive source 124 to the platen 112, regardless of a position of the platen 112 shifted on the frame unit 118.

The sheet guide 120 is formed to have, e.g., a resinous molded body, and includes a guide surface 148 having a concavely curved profile corresponding to the cylindrical outer circumferential surface of the body 138 of the platen 112. The sheet guide 120 is disposed between the side plate parts 118*b* of the frame unit 118 with the guide surface 148 facing opposite to the platen body 138. The guide surface 148 of the sheet guide 120 extends preferably over general the axial entire length of the platen body 138, so that a sheet passage formed from a generally constant gap is defined between the guide surface 148, the outer circumferential surface of the platen body 138 and the side plate parts 118*b* of the frame unit 118.

Figure 18:
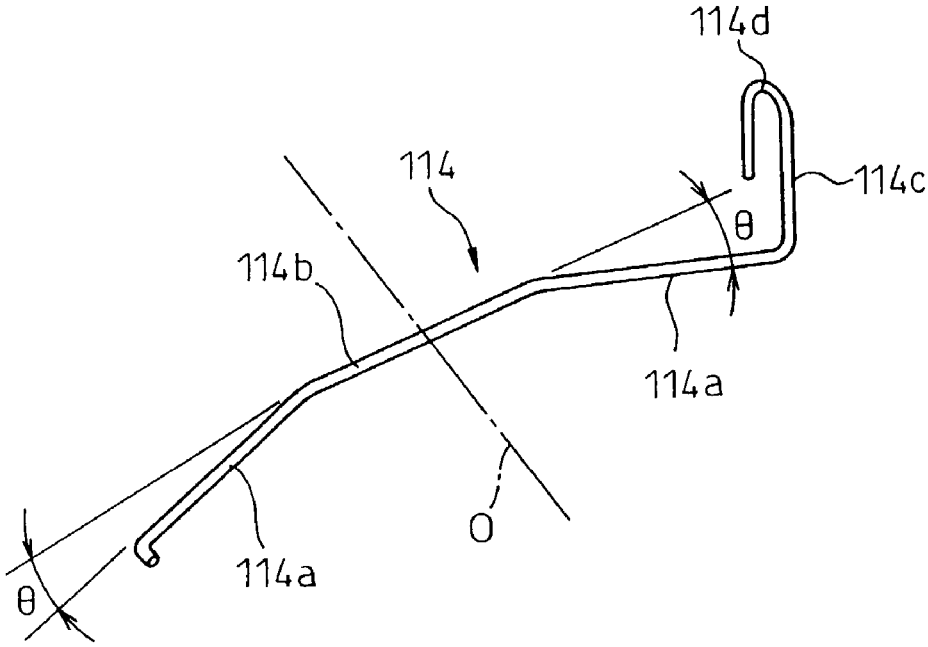
FIG. 18 is an enlarged perspective view showing an elastic member installed in the thermal printer of FIG. 15.

As the characteristic feature of this embodiment, the elastic member 114 is formed from a bar-shaped spring arranged between the frame unit 118 and the platen 112. The elastic member 114 formed from the bar-shaped spring is made of an elastic metal-wire material such as a spring steel, and integrally includes a pair of elastic arm portions 114*a* joined to the platen 112, and a support portion 114*b* located between the elastic arm portions 114*a* and supported on the frame unit 118. As shown in FIG. 18, the support portion 114*b* extends linearly over a predetermined length, and the pair of elastic arm portions 114*a* extend linearly over generally the same lengths as each other while defining generally the same angles θ relative to the support portion 114*b* at generally the same sides of the latter. Therefore, the support portion 114*b* and the pair of elastic arm portions 114*a* of the elastic member 114 have substantially a symmetrical shape relative to a center cross line O of the support portion 114*b*. In the illustrated embodiment, one elastic arm portion 114*a* terminates at one end of the wire material of the elastic member 114, and the other elastic arm portion 114*a* is integrated at the distal end thereof with a lever portion 114*c*. The lever portion 114*c* extends generally in orthogonal to the elastic arm portion 114*a*, and terminates at the other end of the wire material of the elastic member 114 through a knob portion 114*d* bent into a U-shape.

The pair of elastic arm portions 114*a* of the elastic member 114 are connected to the axial opposite ends of the shaft 134 of the platen 112 through the bearing members 136, respectively, as described above. Each elastic arm portion 114*a* of the elastic member 114 is rotatably and slidably fitted into the fitting hole 136*c* of each bearing member 136 at the distal end length thereof away from the support portion 114*b*. In the illustrated embodiment, in order to facilitate the assembling work, one bearing member 136 fitted with one elastic arm portion 114*a* adjacent to the lever portion 114*c* of the elastic member 114 is provided with the fitting hole 136*c* having a different profile, which extends through a slit 136*d*, into which the elastic arm portion 114*a* can be inserted, to open at the outer peripheral edge of the bearing member 136.

The support portion 114*b* of the elastic member 114 is rotatably hooked or suspended in a catch 150 provided on the outer surface of the ceiling plate part 118*a* of the frame unit 118. The catch 150 has a pair of walls (FIG. 16) uprightly projecting from the ceiling plate part 118*a*, and the support portion 114*b* of the elastic member 114 is permitted to fit into a clearance between the walls in a snap fit manner under the elastic deformation of the walls. The elastic member 114 is positioned in such a manner that the center cross line O (FIG. 18) of the support portion 114*b* coincides with a cross line extending just along a central midway between the bearing members 136 on the platen shaft 134. The elastic member 114 is able to rotate about the support portion 114*b* relative to the frame unit 118 with the support portion 114*b* being suspended in the catch 150, and following this rotation, the pair of elastic arm portions 114*a* are able to pivot relative to the frame unit 118.

Figure 19A:
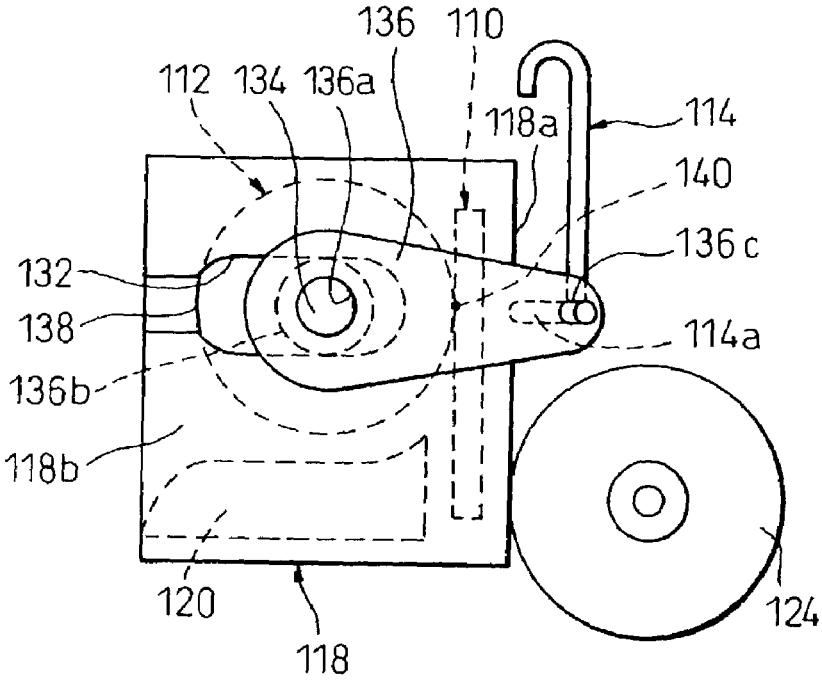
FIG. 19A illustrates an operation of the elastic member in the thermal printer of FIG. 15, with a platen in a printable position.
Figure 19B:
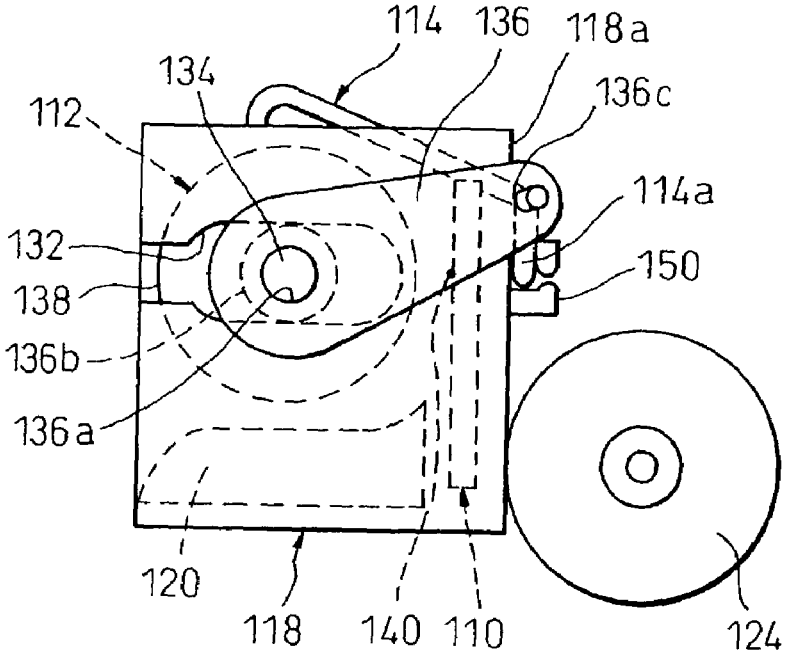
FIG. 19B illustrates the operation of the elastic member with the platen in an inoperative position.

During a period when the elastic member 114 rotates on the frame unit 118, the distance between the distal end portion of each elastic arm portion 114*a*, away from the support portion 114*b*, and the ceiling plate part 118*a* of the frame unit 118 changes. Along with this distance change, as shown in FIGS. 19A and 19B, the pair of bearing members 136 fitted to the distal end areas of both elastic arm portions 114*a* pivot about the shaft 134 of the platen 112, and the platen shaft 134 connected to the elastic arm portions 114*a* via the bearing members 136 are linearly guided to shift while keeping a parallel positional relationship, under the sliding engagement between the sleeve portions 136*b* of the bearing members 136 and the support openings 132 of the frame unit 118. Thus, the pair of bearing members 136 function as link members that transmit the rotating motion of the elastic member 114 to the platen shaft 134 so as to move the platen 112.

More specifically, when the elastic member 114 rotates in a direction to shift the distal end regions of the elastic arm portions 114*a* toward the ceiling plate part 118*a* of the frame unit 118, the elastic member 114 makes the pair of bearing members 136 pivot in a counterclockwise direction in FIG. 19A, and also applies an external force to the platen shaft 134 via the bearing members 136 in a direction away from the ceiling plate part 118*a* of the frame unit 118. As a result, the platen 112 shifts, while keeping a parallel positional relationship, to a non-operative position at which the outer circumferential surface of the body 138 is spaced from the heat generating element 140 on the thermal head 110 by a predetermined distance. At an instant when the distal end regions of the elastic arm portions 114*a* of the elastic member 114 are brought into closest to the ceiling plate part 118*a* of the frame unit 118, the platen 112 reaches the non-operative position (FIG. 19B). In this position, the elastic member 114 is subjected to substantially no elastic deformation, and thus is located in a release position for releasing the platen 112 from the elastic biasing force. In this state, it is possible to easily insert the leading end of the printing sheet P into a clearance defined between the thermal head 110 and the platen 112.

On the other hand, when the elastic member 114 rotates in a direction to shift the distal end regions of the elastic arm portions 114*a* away from the ceiling plate part 118*a* of the frame unit 118, the elastic member 114 makes the pair of bearing members 136 pivot in a clockwise direction in FIG. 19B, and also applies external force to the platen shaft 134 via these bearing members 136 in a direction toward the ceiling plate part 118*a* of the frame unit 118. As a result, the platen 112 shifts, while keeping a parallel positional relationship, to a printable position at which the outer circumferential surface of the body 138 is uniformly pressed to the heat generating element 140 on the thermal head 110. Immediately before the distal end regions of the elastic arm portions 114*a* of the elastic member 114 are spaced farthest from the ceiling plate part 118*a* of the frame unit 118, the platen 112 reaches the printable position. From this position, when the elastic member 114 is further rotated, the platen 112 is substantially no longer movable, so that the elastic arm portions 114*a* start to be elastically deformed, and elastic biasing force corresponding to this deformation is applied to the platen shaft 134 via the pair of bearing members 136. At an instant when the elastic arm portions 114*a* are spaced farthest from the ceiling plate part 118*a* of the frame unit 118, the elastic member 114 is located in an operative position, and maximum elastic biasing force is applied to the platen shaft 134 (FIG. 19A).

As explained above, during a period when the elastic member 114 is located in the operative position shown in FIG. 19A, the pair of elastic arm portions 114*a* are subjected to generally the same elastic deformation as each other, to exhibit generally the same spring force. Consequently, the elastic member 114 applies the elastic biasing force balanced in the rotation axis direction to the shaft 134 of the platen 112 via the pair of bearing members 136, so as to urge the platen 112 in a direction toward the thermal head 110. During a period when the platen 112 is located in the printable position, the elastic member 114 generates a required contact pressure between the thermal head 110 and the platen 112, which makes it possible to absorb dimensional and positional errors of the thermal head 110 and the platen 112 as well as to achieve a stable printing operation in correspondence to the change in thickness of the printing sheet P.

Figure 20A:
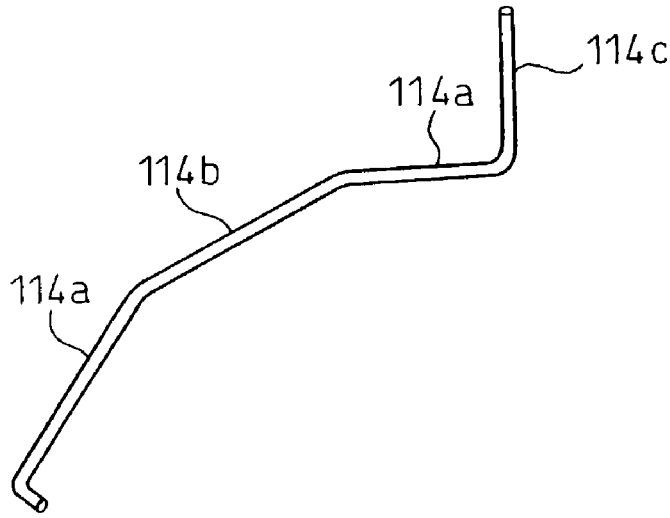
FIG. 20A is a perspective view of one modification of the elastic member of FIG. 18.
Figure 20B:
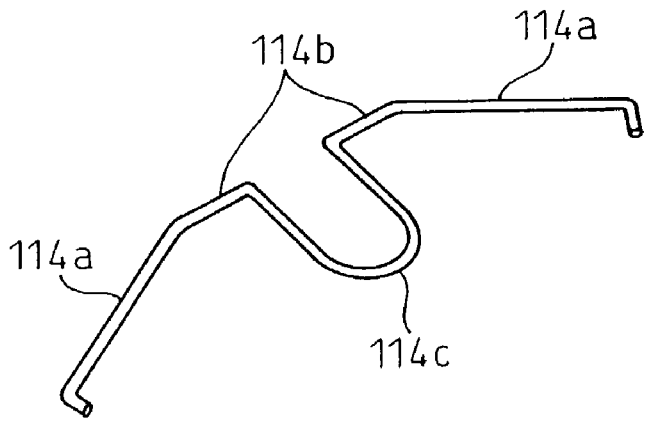
FIG. 20B is a perspective view of another modification of the elastic member of FIG. 18.

The elastic member 114 made of a bar-shaped spring is not limited to have the structure as explained above, and the U-shaped knob portion 114*d* at the distal end of the lever portion 114*c* may be omitted, as shown in FIG. 20A. It is also possible, as shown in FIG. 20B, to provide another lever portion 114*c* bent in a U-shape at the center area of the support portion 114*b*.

Figure 21A:
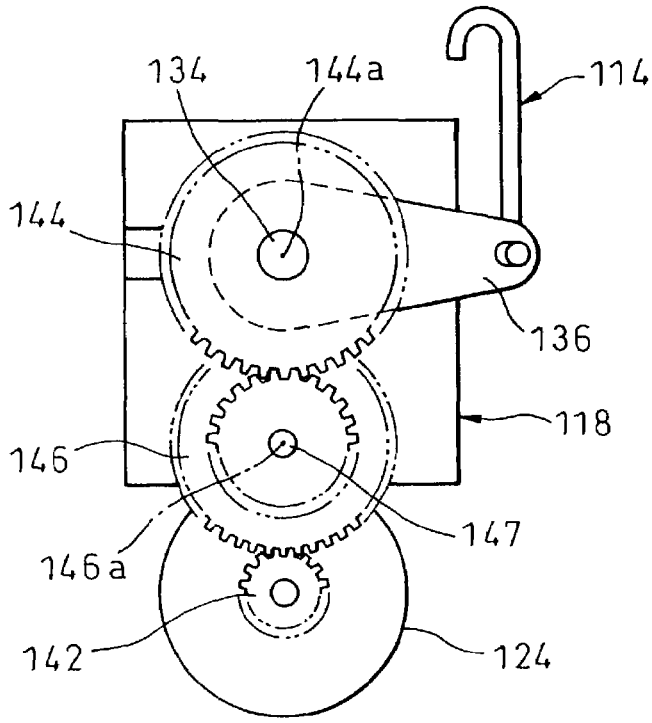
FIG. 21A is a front view of a gearing unit in the thermal printer of FIG. 15.
Figure 21B:
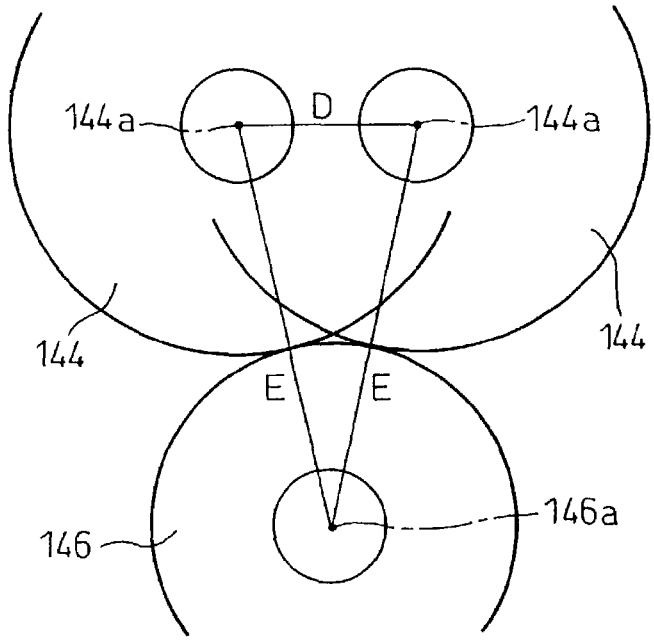
FIG. 21B illustrates an operation of the gearing unit.

In the above structure of the third embodiment, when the platen 112 passively shifts relative to the thermal head 110 due to, e.g., the variation in thickness of the printing sheet during a period when the printing sheet is fed by the platen 14 driven for rotation (e.g., during a printing operation) by the rotation drive mechanism 116, the engagement condition (e.g., backlash) between the driven gear 144 and the former or prior intermediate gear 146 in the gearing unit 126 changes to some extent. In order to reduce a torque transmission loss or noise in the gearing unit 126 as far as possible, it is necessary to minimize such a change in the engagement condition. To this end, it is advantageous that, as shown in FIG. 21A, the intermediate gear 146 is disposed to be aligned with the driven gear 144 in a direction generally orthogonal to an estimated passive shifting locus of the platen 112 or the driven gear 144 (i.e., a vertical downward direction in the drawing). In this arrangement, the rotation axis 146*a* of the intermediate gear 146 (i.e., the platen rotation axis 112*a*) is located at a position defining a common distance E from the rotation axis 144*a* of the driven gear 144 which is positioned at the respective limits of a passive shifting range D of the platen 112, as schematically shown in FIG. 21B. According to this structure, it is possible to minimize a change in the engagement condition between the driven gear 144 and the intermediate gear 146. In order to facilitate such a relative positioning of gears in the gearing unit 126, it is also possible to dispose the rotation drive source 124 at a position below the frame unit 118, as shown in FIG. 21A.

According to the thermal printer having the above structure, it is possible to omit the supporting or heat-radiation plate of the thermal head 202, the plate spring 206 for biasing the thermal head, the head pivot axis and the head release lever, in the conventional thermal printer shown in FIG. 22. Therefore, even when the thermal head 110 and the platen 112 are disposed in laterally parallel with each other, in a similar way to the conventional thermal printer shown in FIG. 22, it is possible to effectively reduce the dimension of the printer casing particularly in the length (or depth) direction. From this viewpoint, the reduction in number of parts and the corresponding reduction in cost are caused due to the addition of a function, for connecting the elastic member 114 with the platen shaft 134, to the bearing members 136, which itself is provided to reduce the friction between the platen shaft 134 and the frame unit 118, and the provision of the lever portion 114*c* for actuation, on the bar-shaped spring constituting the elastic member 114.

As is apparent from the above description, according to the present invention, it becomes possible to reduce the external dimensions of a thermal printer having a drive platen, to a level suitable for use in connection with portable information apparatuses, while maintaining a required printing function. Also, according to the invention, it becomes possible to preset a printing sheet easily and quickly in a printable state, even when the external dimensions of the thermal printer is significantly reduced.

While the invention has been particularly shown and described with reference to preferred embodiments thereof, it will be understood by those skilled in the art that various changes and modifications may be made without departing from the spirit and scope of the following claims.

What is claimed is:

1. A thermal printer comprising:

a thermal head;

a platen cooperating with said thermal head to nip a printing sheet between said platen and said thermal head;

an elastic member elastically pressing said thermal head and said platen to each other;

a frame carrying said thermal head in a fixed manner and said platen in a movable manner relative to said thermal head; and a drive mechanism driving said platen; said drive mechanism including a rotation drive source, a gearing unit for transmitting a torque from said rotation drive source to said platen, and a pivot member capable of pivoting about a rotation axis of a gear, arranged prior to said platen in said gearing unit, together with said platen and following gears arranged behind said gear.

2. A thermal printer as set forth in claim 1, wherein said elastic member applies elastic biasing force to said pivot member for biasing said platen toward said thermal head about said rotation axis of said gear.

3. A thermal printer as set forth in claim 1, wherein said thermal head includes a printing face with a heat generating element located therein, and wherein said frame includes a guide mechanism guiding said platen along an arcuate path extending about said rotation axis of said gear to a printable position at which said platen is uniformly pressed against said heat generating element in said printing face.

4. A thermal printer as set forth in claim 1, wherein said gear having said rotation axis as a pivoting center of said pivot member is a driving gear fixed to an output shaft of said rotation drive source.

5. A thermal printer as set forth in claim 1, further comprising a sheet guide arranged near said platen to define a sheet passage, wherein said sheet guide is interlocked with said pivot member to be shiftable between a guide position close to said platen for inducing the printing sheet to be fed along a surface of said platen and an open position away from said platen for facilitating the printing sheet to be introduced into said sheet passage.

6. A thermal printer as set forth in claim 5, further comprising a connecting mechanism between said pivot member and said sheet guide, said connecting mechanism capable of retaining said sheet guide in said open position under elastic biasing force of said elastic member.

7. A thermal printer as set forth in claim 1, wherein said thermal head is directly fixed to said frame, so that said frame serves to radiate heat generated in said thermal head.

8. A thermal printer comprising:

a thermal head;

a platen cooperating with said thermal head to nip a printing sheet between said platen and said thermal head;

an elastic member elastically pressing said platen to said thermal head to produce a required contact pressure therebetween affording a stable printing operation;

a frame carrying said thermal head in a fixed manner and said platen in a movable manner relative to said thermal head; and a rotation drive mechanism rotationally driving said platen;

wherein said elastic member is arranged between said frame and said platen to bias said platen toward said thermal head by elastic biasing force balanced in an axial direction of said platen.

9. A thermal printer as set forth in claim 8, wherein said elastic member comprises a bar-shaped spring including a pair of elastic arm portions joined to said platen and a support portion located between said elastic arm portions and supported on said frame.

10. A thermal printer as set forth in claim 8, wherein said elastic member is shiftable between an operative position for applying said elastic biasing force to said platen and a release position for releasing said platen from said elastic biasing force.

11. A thermal printer as set forth in claim 10, further comprising a link member arranged between said elastic member and said platen, said link member transmitting a shifting motion of said elastic member between said operative position and said release position to said platen so as to move said platen.

12. A thermal printer as set forth in claim 8, wherein said thermal head includes a printing face with a heat generating element located therein, and wherein said frame includes a guide mechanism guiding said platen to a printable position at which said platen is uniformly pressed against said heat generating element in said printing face.

13. A thermal printer as set forth in claim 8, wherein said thermal head is directly fixed to said frame, so that said frame serves to radiate heat generated in said thermal head.

* * * * *